US012285067B2

(12) United States Patent
Breci

(10) Patent No.: US 12,285,067 B2
(45) Date of Patent: Apr. 29, 2025

(54) METHOD OF INSTALLING HAND-TIED NATURAL HAIR EXTENSIONS

(71) Applicant: Michaela Breci, Windsor, CA (US)

(72) Inventor: Michaela Breci, Windsor, CA (US)

(73) Assignee: MANE LUXE LLC, Windsor, CA (US)

( * ) Notice: Subject to any disclaimer, the term of this patent is extended or adjusted under 35 U.S.C. 154(b) by 170 days.

(21) Appl. No.: 18/148,828

(22) Filed: Dec. 30, 2022

(65) Prior Publication Data

US 2023/0210207 A1 Jul. 6, 2023

Related U.S. Application Data

(60) Provisional application No. 63/266,314, filed on Dec. 31, 2021.

(51) Int. Cl.
*A41G 5/00* (2006.01)

(52) U.S. Cl.
CPC ..... *A41G 5/006* (2013.01)

(58) Field of Classification Search
CPC ..... A41G 5/004; A41G 5/0053; A41G 5/006
See application file for complete search history.

(56) References Cited

U.S. PATENT DOCUMENTS

| | | | | |
|---|---|---|---|---|
| 5,121,761 | A | 6/1992 | Meister | |
| 11,419,375 | B2 | 8/2022 | Rangel | |
| 11,419,376 | B2 | 8/2022 | Turley | |
| 2011/0197908 | A1* | 8/2011 | Waters | A41G 5/0086 132/201 |
| 2014/0060566 | A1 | 3/2014 | Walker | |
| 2019/0357614 | A1 | 11/2019 | Rangel | |
| 2022/0386725 | A1* | 12/2022 | Turley | A41G 5/0073 |

* cited by examiner

*Primary Examiner* — Rachel R Steitz
(74) *Attorney, Agent, or Firm* — Andrew F. Young, Esq.; NOLTE LACKENBACH SIEGEL

(57) ABSTRACT

A method of installing and attaching a hidden row of hand-tied natural human hair extensions onto the wearer's hair to supplement hair thickness, volume, and length, wherein the method minimizes stress and tension on the wearer's hair and scalp, thereby increasing comfort and reducing adverse scalp health impacts.

1 Claim, 32 Drawing Sheets

METHOD OF INSTALLING HAND-TIED NATURAL HAIR EXTENSIONS

CROSS REFERENCES TO RELATED APPLICATIONS

The present application claims the benefit of the filing date of U.S. Provisional Patent Application Ser. No. 63/266,314, filed Dec. 31, 2021 (Dec. 31, 2021), which application is incorporated in its entirety by reference herein.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

Field of the Invention

The present invention relates most generally to hair styling, and more particularly to methods of attaching hair extensions to natural hair, and still more particularly to a method of installing and attaching a hidden row of hand-tied natural human hair extensions onto the wearer's hair to supplement hair thickness, volume, and length.

Background Discussion

While the evolutionary advantages of healthy hair may be somewhat speculative, most evolutionary biologists and psychologists agree that a healthy and full head of hair (along with other body hair) conferred an advantage on the individual. It protected the scalp and skull and possibly provided means for a suckling infant to anchor and hold to a nursing mother. Moreover, one must be healthy to produce attractive, glossy, full strands of hair. The natural inferences for pair bond candidates needn't be expressed. Suffice it to say that hair has signaled a fitness for reproduction and child rearing, which ultimately translates into the most fundamental kind of attraction. Little wonder, then, why a full, long, and healthy head of hair is highly attractive in women. And little wonder why women might seek intelligent and effective ways to enhance this most visible asset.

It's a trivial and obvious statement that the entire hair styling industry—shampoos and conditioners, dyes and coloring products, rollers and combs and brushes, and myriad other products and services directed to hair products—consumes a profusion of resources; it's much less trivial or obvious when actual expenditures to purchase hair products and accessories are considered. According to a Grand View Research study published in November 2021, the global hair accessories market size was valued at $17.4 billion USD in 2020, and it is expected to compound annually by 7.7%. The revenue speaks volumes: having beautiful hair matters immensely. And to discriminating consumers, it matters that the most beautiful head of hair be attainable at a reasonable price.

A relative newcomer to the many strategies for enhancing hair, hair extensions are increasingly popular. They involve the use of synthetic or natural human hair to cosmetically enhance a wearer's hair thickness, volume, and length. The results can be quite spectacular and even life changing for an individual seeking enhancement to a degree essentially unattainable through styling and product use alone—even through careful and closely managed long term growth and styling. Simply put, some wearers could not possibly achieve the visual enhancement provided by hair extensions, and certainly not in the few hours it takes a skilled and trained stylist to install the extensions.

Hair extensions have become extremely popular, yet they remain relatively expensive. There are several ways in which hair extensions can be installed in a wearer's natural hair, including: (1) fusion hair extensions, which entail fusing keratin-tipped strands either cold or using ultrasound energy to bond the extensions to a wearer's hair—they are very expensive; (2) tape-in hair extensions, which entail simply taping the extensions to the wearer's hair using an invisible, double-sided tape, and which are economical but require significance maintenance; and (3) weave hair extensions, which are installed by braiding a connection of the extension to rows of the wearer's natural hair, an economical and relatively quick installation method, but providing a short-lived result. Several other methods, including natural beaded rows extensions, glue-in hair extensions, clip-in hair extensions, halo hair extensions, micro link strand-by-strand hair extensions, micro link skin weft hair extensions, and pre-bonded micro loop hair extensions.

Of the foregoing methods, many cause damage to the hair when installed (adhesive and heat bonding, most notably), and many are either difficult to remove or are time-consuming to remove.

It is thus a principal object and advantage of the present invention to provide a method of installing hair extensions that is economical, does not cause damage to the wearer's hair, is comfortable and does not introduce deleterious tension into a client's scalp or on hair follicles, enables easy removal for blending and maintenance, and can be accomplished by a stylist after training with an accessible, non-technical training program.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein:

FIG. 13D illustrates the fourth phase thereof;

DETAILED DESCRIPTION OF THE INVENTION

While the inventive styling technique may be practiced by skilled amateurs, it is a technique most likely to remain the province of trained hair stylists and technicians. Thus, in the following technical description, a commercial setting is assumed, and the term "client" is therefore used to refer to the person for whom the hair extension services are being provided. The terms "stylist" and/or "technician" are used to refer to the person carrying out the method steps.

To install, blend, and conceal the attachment structures for hand-tied natural hair extensions using the method of the present invention, the technician/stylist first gathers and organizes tools and equipment prior to the client's arrival. These tools include the following: bead closer pliers, a bead opener, a bead crimper, cross hair clips, a looper tool, cotton thread, 5 mm or 3 mm silicone beads, weft clips, and a C-curved needle. These are shown in FIGS. 6A-6I.

Figure 1A:
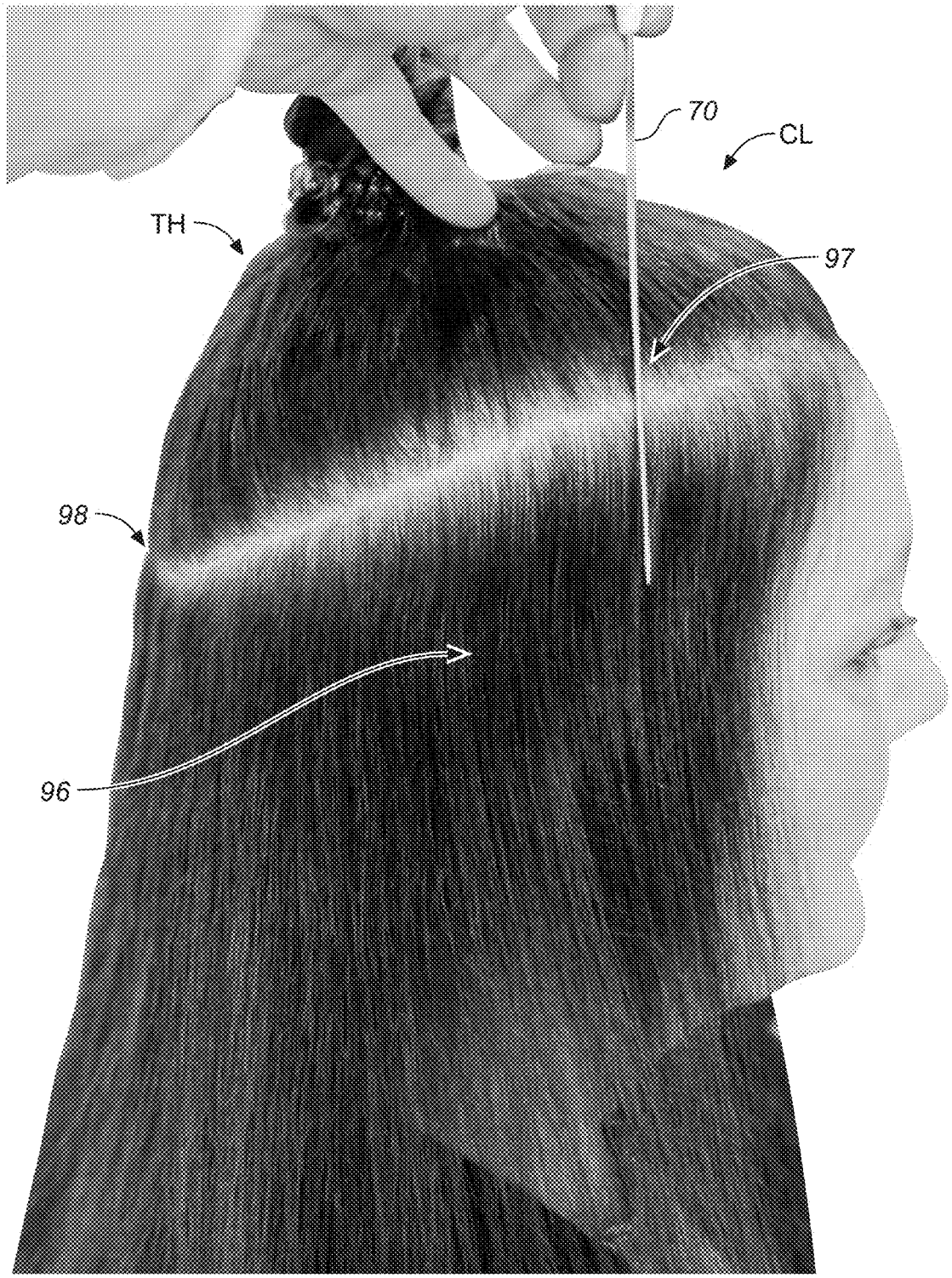
FIG. 1A is photographic right rear perspective view showing a first method step in a set of steps for installing a hidden row of hand-tied hair extensions to a wearer's natural hair, this set of steps directed to sectioning the client's hair per row section.

As a first step, the client's hair CL is washed and dried. Then, and referring now to FIG. 1A, the process begins by sectioning the top TH of the client's hair. For maximum coverage, the section may be started approximately one inch under the client's part line and approximately two inches away from the hairline above the ear 96, rounding the horseshoe section to one half (½) inch above the occipital bone. This is the highest placement for a section. Each row section can start approximately two inches back from the hair line 97, ½ inch below the occipital bone and approximately two inches below the back cowlicks 98.

Figure 1B:
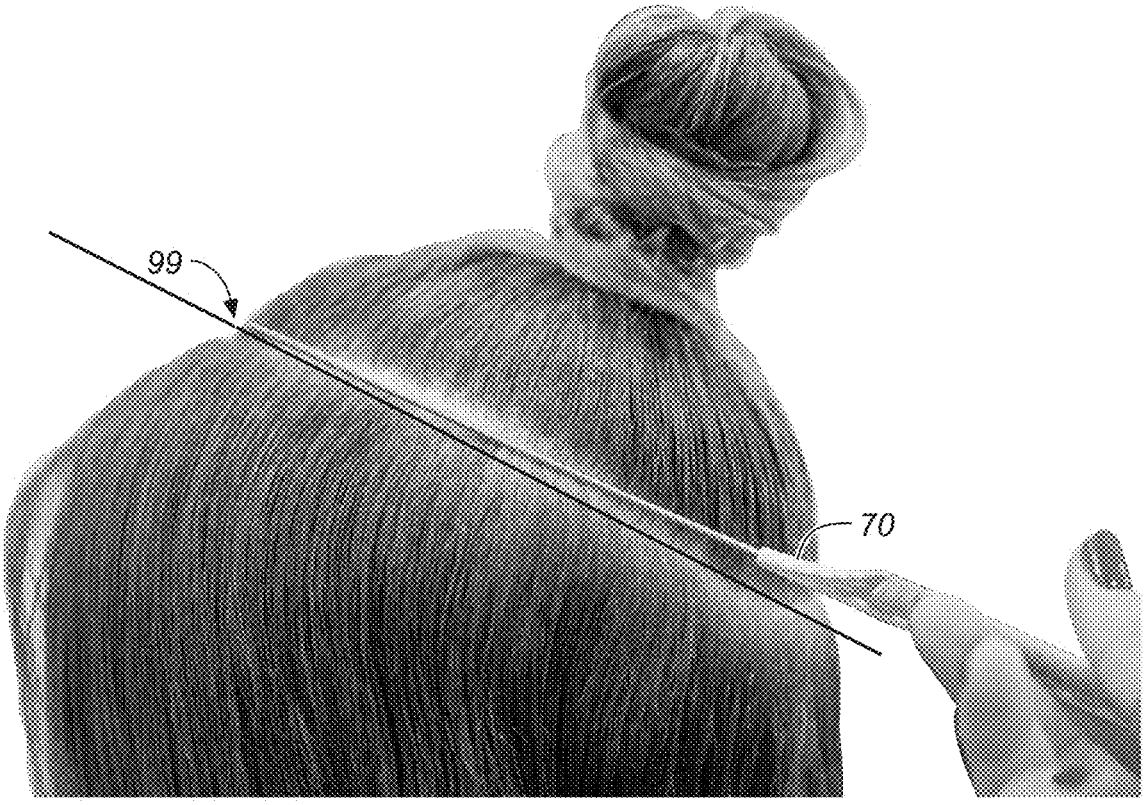
FIG. 1B is a left rear perspective view thereof showing the angle that must be maintained in the sectioning process.

Looking next at FIG. 1B, following the natural shape of the head and using a horseshoe-sectioning technique, the stylist next creates a guide using an index finger, starting at each side of the head and connecting to the back at a substantially 45-degree angle relative to ground with the head level, taking care to avoid the recession area and temple area of the head 106. The stylist ensures the sectioning lines are clean with no cross hairs, humps, or arches.

Using a comb as a guide, the stylist then straightens and smooths the angled section, gathering the top section of the client's hair on top of the head in a high bun. It is important to keep the section lines clean and unobstructed with no crosshairs, humps, or arches in the hair. The purpose of the bun is to separate the hair and allow for a clean section to work in, unimpeded by uncontrolled strands of hair. Every portion of the client's natural hair is controlled throughout the entire process. For this purpose, a ponytail, for instance, would not be effective, as the tail would dangle in the area in which the stylist is working. While it is possible to twist and clip a tail, a bun is recommended as it keeps the hair tight and the hair sections clean.

Thus, after the sectioned portion is clean and with no cross hairs, the stylist directs the top section of hair to a high ponytail, twists the end of the ponytail, and wraps the tail clockwise around itself to form a bun. The stylist then uses an elastic hair scrunch or coiled hair tie to secure the bun on top of the head. At this point the stylist can use water, hair spray or hook and loop fasteners to clean up any missed "flyaways" or cross hairs.

Rows are then prepared in the hair to attach the extensions by placing beads on rectangular sections of hair. A mirror is used as a guide to view the sectioning and to ensure that the "start" and "end" beads are symmetrical. To ensure proper placement of the rows, the stylist places a finger where the row will lay and pulls the hair up. If the fingers show, the stylist must shift the section higher, using a comb as a guide for finding the 45-degree angle and avoiding the formation of any humps or arches in the hair.

The density of the client's hair influences and informs the placement of the sections and rows. For thin hair, the stylist ensures that the client has enough hair to cover the extensions. The row placement for thin hair will be closer together for two to three or more rows. For medium hair, the rows will vary from one to two inches apart with normal density. Clients with thick hair will have two to three or more rows. For thick hair, the bottom row must be placed lower on the head to avoid a noticeable weight line in the window area.

Figure 2:
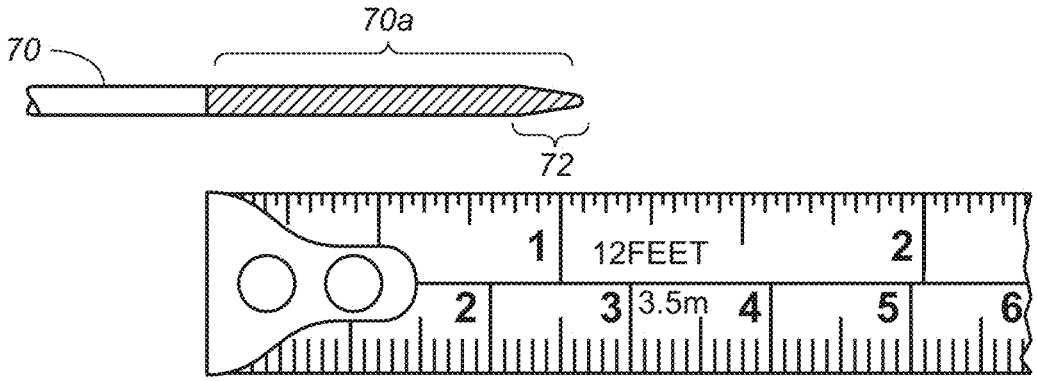
FIG. 2 illustrates first and second sectioning measurement elements of a hair separator tool.
Figure 3A:
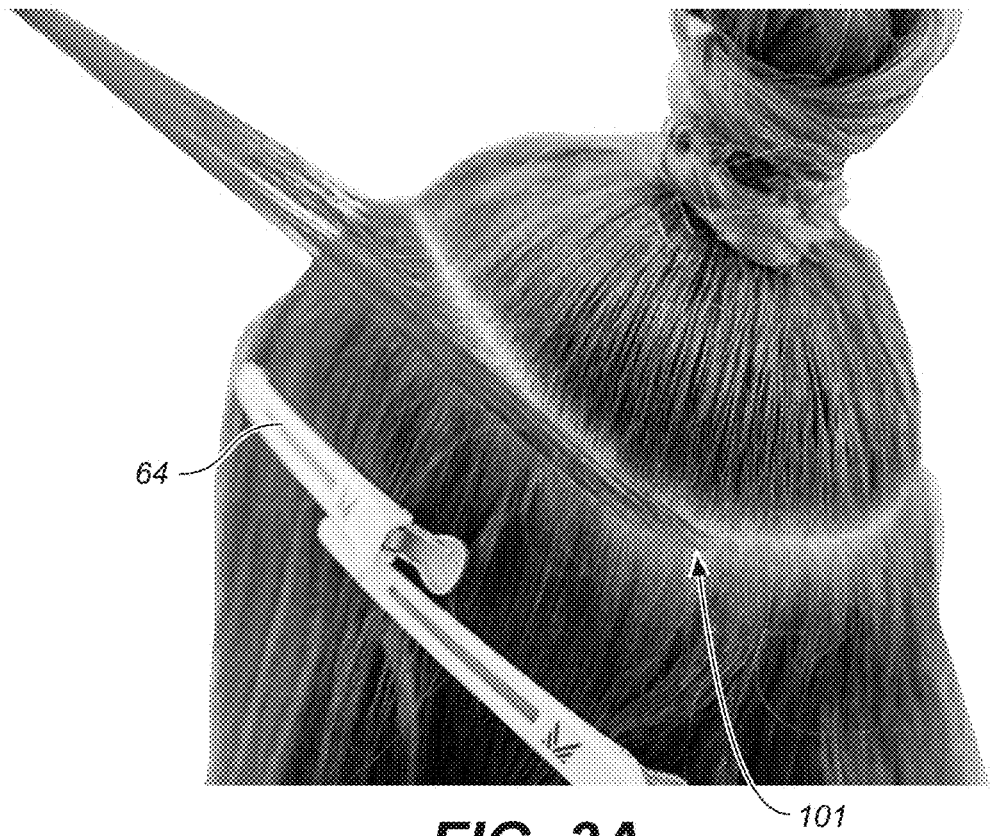
FIG. 3A illustrates the first sectioning step made in preparation of using a hair separator.
Figure 3B:
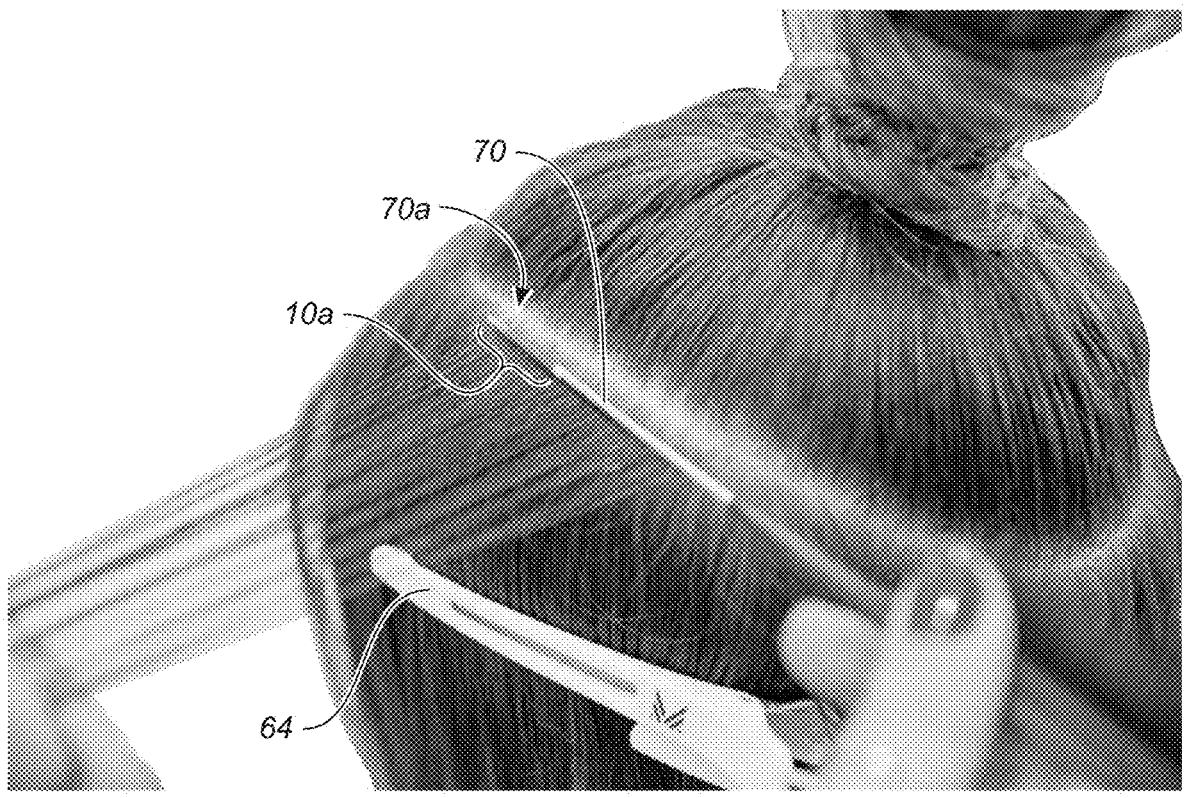
FIG. 3B shows a progression on sectioning using the hair separator and shows the shape of each section.

As shown in FIGS. 3A-3B, the depth of the row will be ⅛ inch to ¼ inch deep depending on the hair density. Thicker, higher density hair requires ⅛-inch-deep sections, while thinner, lower density hair, requires ¼-inch-deep sections. Using a pre-marked hair separator 70, with a visually marked gauge portion 70*a* at the distal end of the shaft (FIG. 2], the rows are divided into 1⅛ inch-wide rectangular sections 100 [FIG. 3B]. A bead will be threaded into this rectangular section, creating what is known as a "bead dropout section." As with the first section, the stylist works at approximately two (2) inches back from the hair line, using a finger as a guide for the row placement. The stylist begins by creating sections at the front and sides of the head, connecting beads in the back section last. Corners are not created in these sections as this can create tension when stitching the extensions. Instead, corners are carved in a C shape to create a rounded rectangle.

Figure 4A:
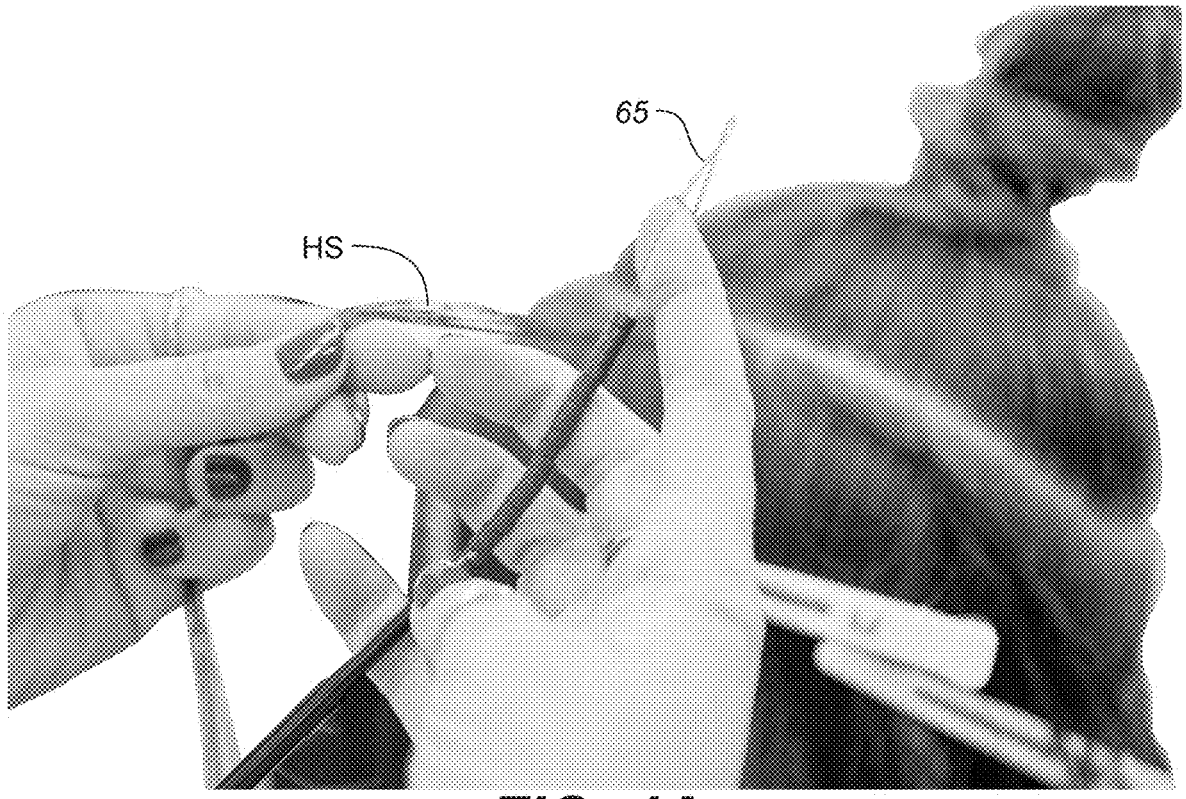
FIG. 4A illustrates the first step in a set of steps of pulling hair through a bead using a looper tool.
Figure 4B:
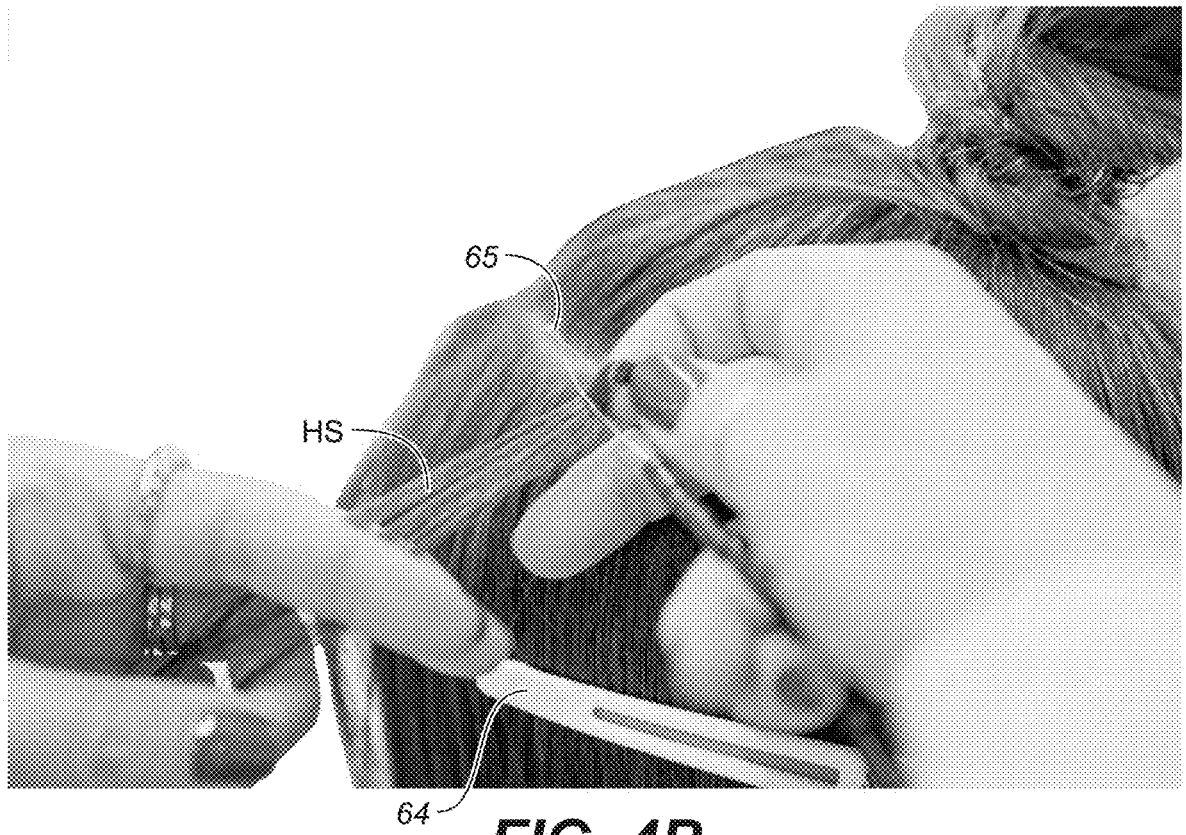
FIG. 4B is the next step thereof.
Figure 4C:
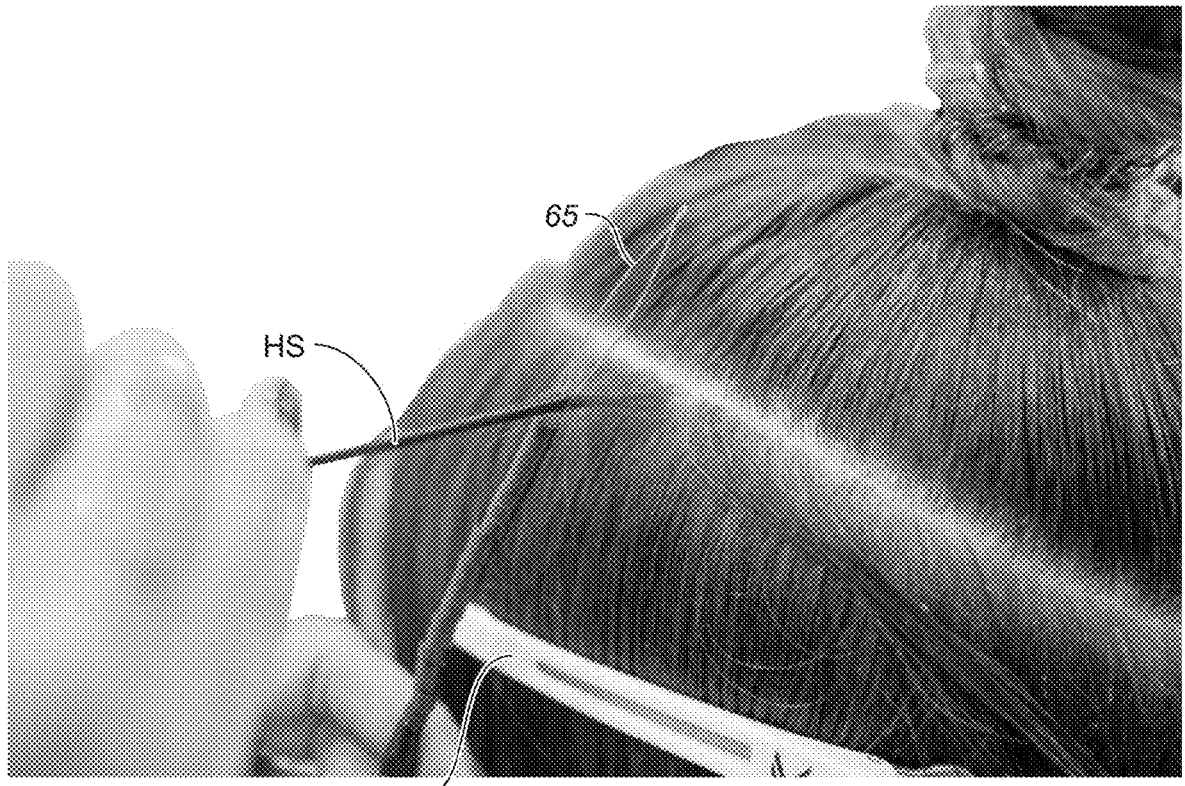
FIG. 4C is the next step thereof.
Figure 4D:
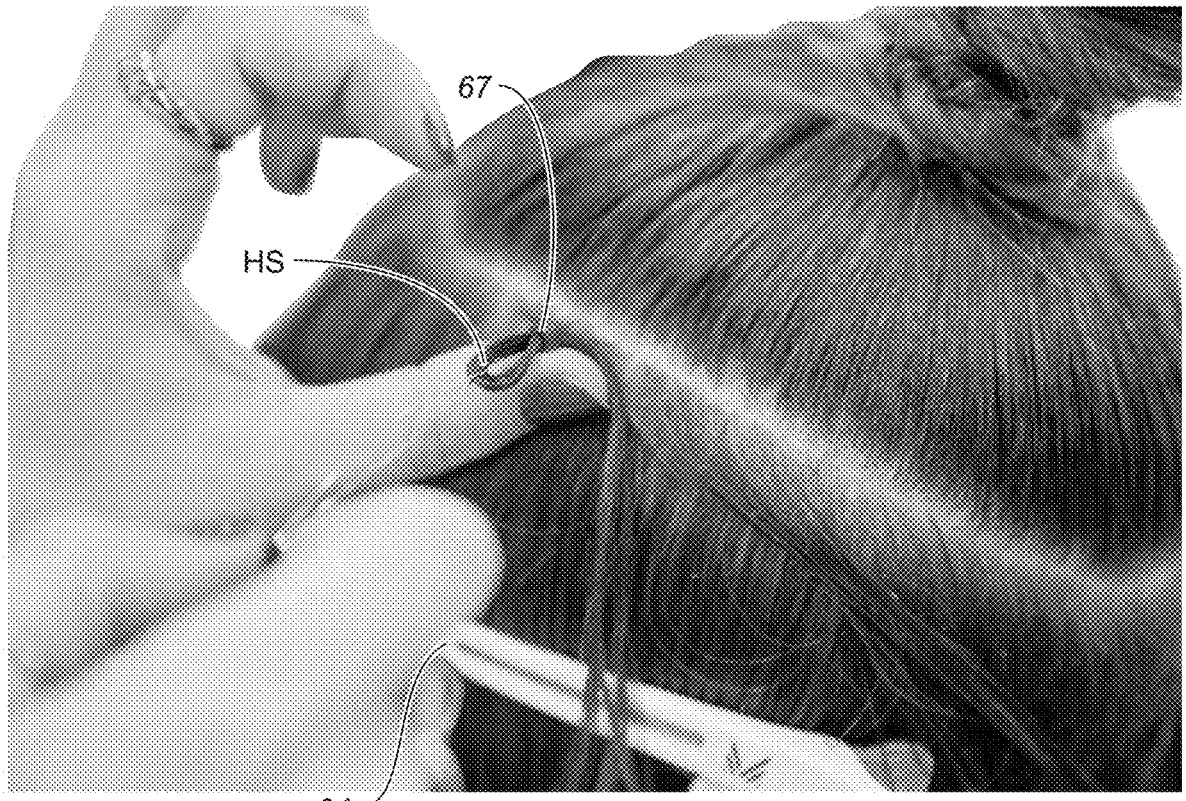
FIG. 4D is the next step thereof.

To create the bead dropout section using a looper tool, the tool is loaded with 5 mm or 3 mm silicone beads as shown in FIGS. 4A-4F. The stylist gathers the client's hair strands HS in the measured rectangular section and opens the end of the tool using the index finger (FIG. 4A). Keeping the index finger inserted through the opening of the tool, the stylist bends the index finger and hooks the 1⅛-inch section of hair with the tip of the finger and pulls the hair section through the looper tool opening (FIGS. 4B-4C). Once the section of hair is pulled through the looper tool, a single bead is opened to a diameter sufficient to accommodate a loop of the sectioned and gathered hair. The stylist then twists and bends the client's hair section and inserts a loop created by the bend through the opened bead (FIG. 4D). He or she then pulls the looper tool toward himself or herself while simultaneously pushing the bead toward the scalp (FIG. 4E) until it is positioned approximately one inch from the section line. This placement prior to the stitching steps described below enables wefts to be stitched together without tension.

Figure 4E:
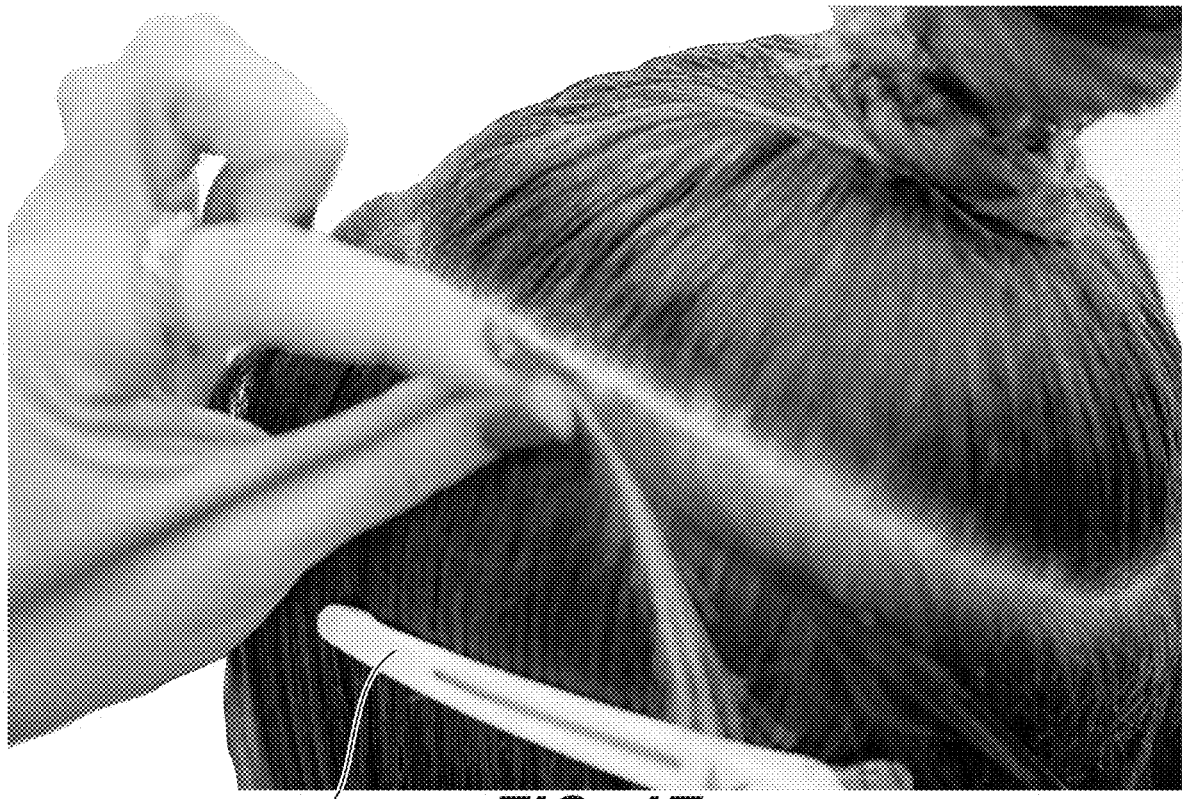
FIG. 4E is the next step thereof.
Figure 4F:
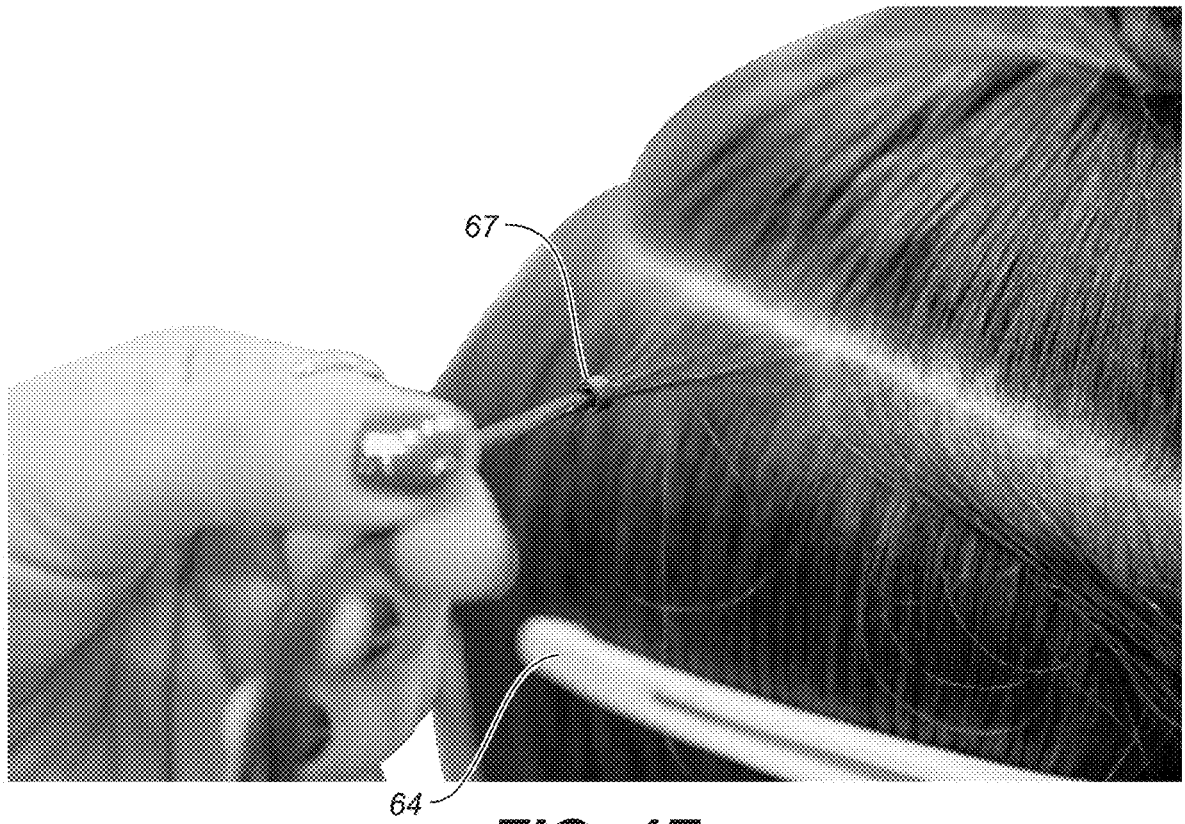
FIG. 4F is the final step of this phase of the process, entailing finishing the bead placement and cleaning and centering the placement.

Next, keeping the bead as close to the scalp as possible, the remaining hair is entirely pulled through the bead, and a clean section with no cross hairs is thereby ensured (FIG. 4E). Once the bead is placed on the section of hair (again, at approximately one inch from the section line), remaining cross hairs are cleaned from the section and the bead is centered (FIG. 4F).

Figure 5:
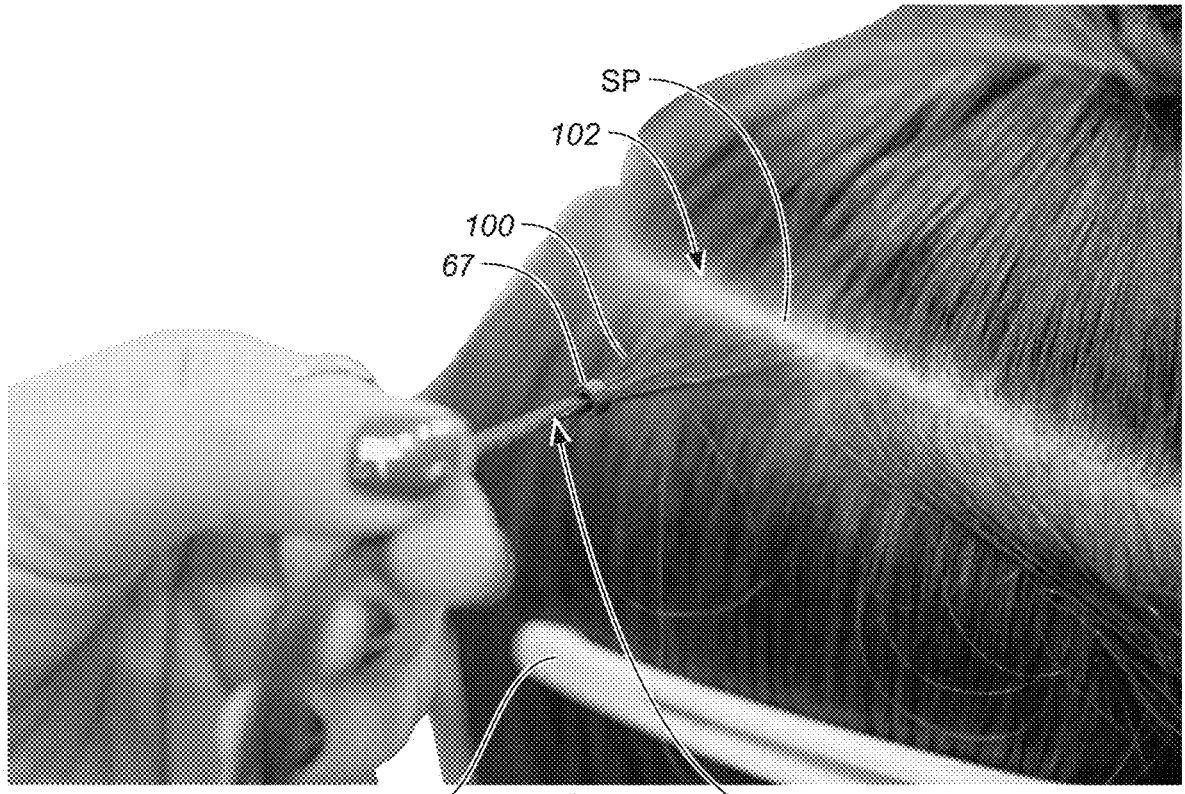
FIG. 5 illustrates a bead placed on a bead drop-down section in preparation for crimping the bead, here showing the section held at an approximate 90-degree angle.

To center the bead as shown in FIG. 5, the beaded section of the hair 100 is held out at an approximate 90-degree angle 102 from the section part SP relative to the client's head, or roughly level with the ground plane, and the bead 67 is positioned in the center of the section in preparation for closing and crimping the bead. This facilitates the creation of an arched (or waterfall) bead section, and such a configuration makes for easy manipulation of the arched bead section upward or downward.

Figure 6C:
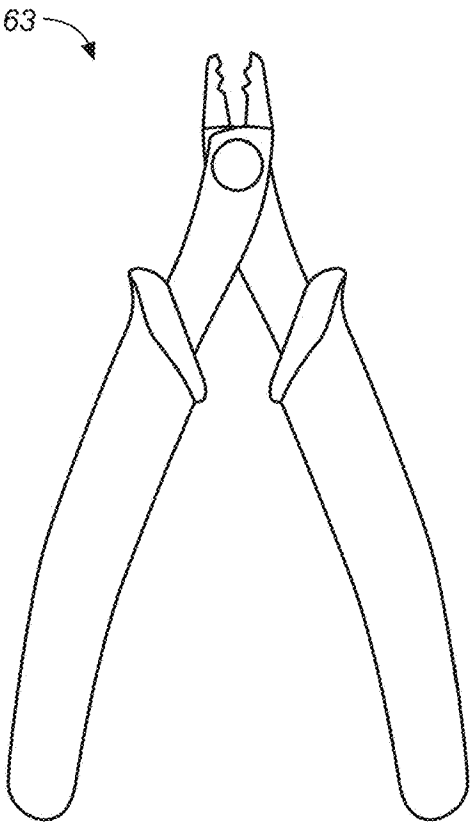
FIG. 6C shows a bead crimper.
Figure 6B:
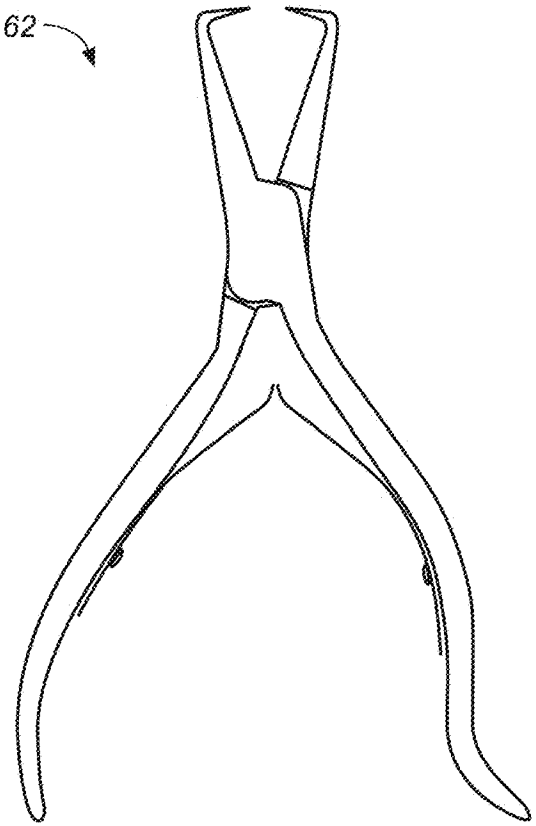
FIG. 6B shows a bead opener tool.
Figure 6A:
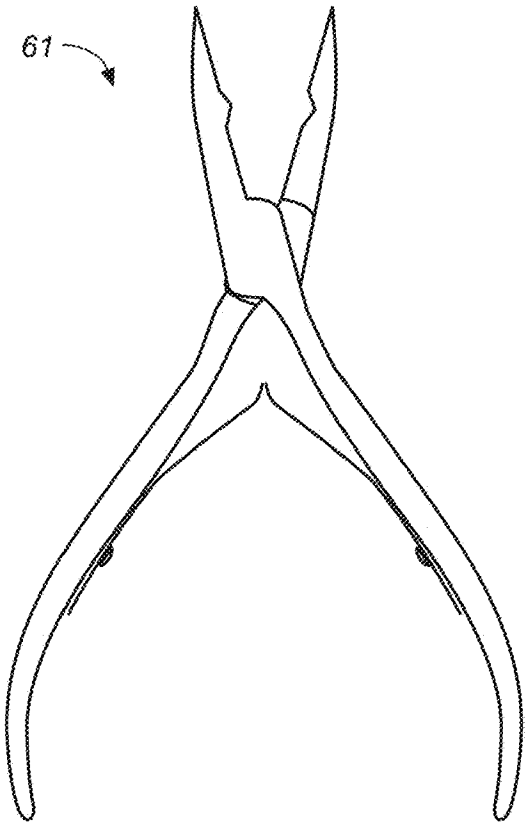
FIG. 6A shows a bead closer tool.
Figure 6F:
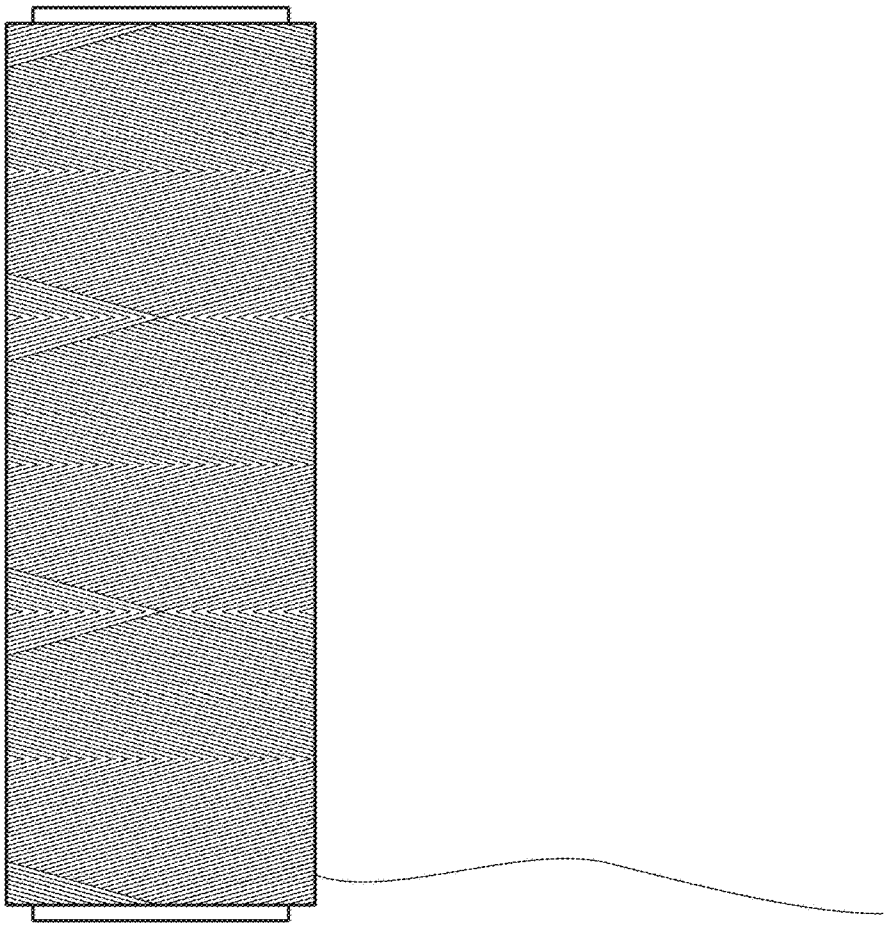
FIG. 6F shows a spool of cotton thread.
Figure 6E:
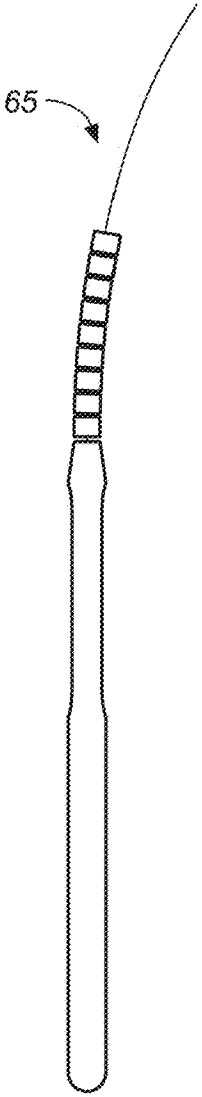
FIG. 6E shows a looper tool.
Figure 6D:
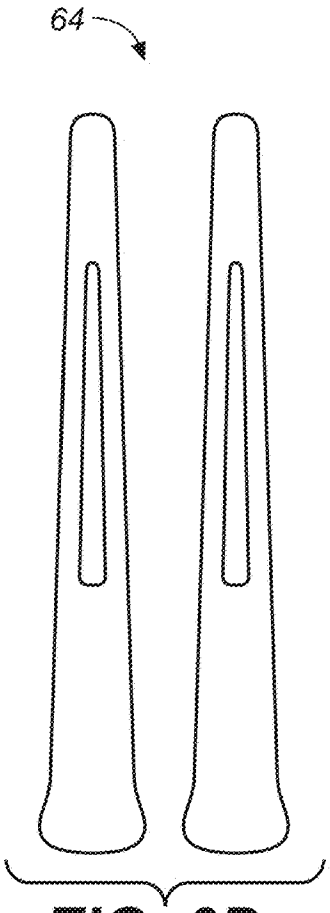
FIG. 6D shows a cross hair clip.
Figure 6H:
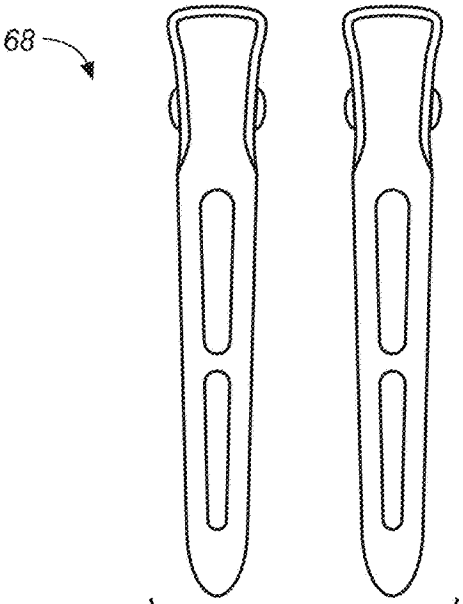
FIG. 6H shows two weft clips.
Figure 6G:
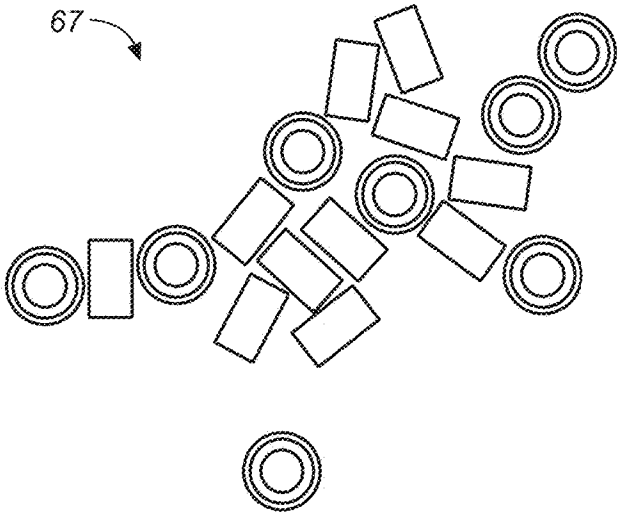
FIG. 6G shows a set of 5 mm silicone beads.
Figure 6I:
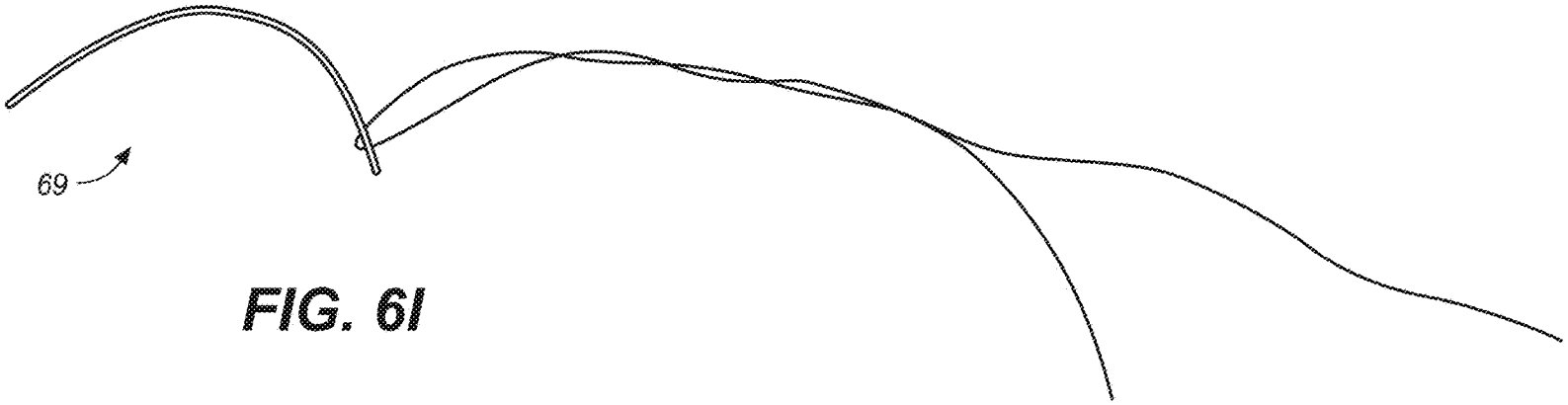
FIG. 6I shows a C-curved needle.
Figure 7A:
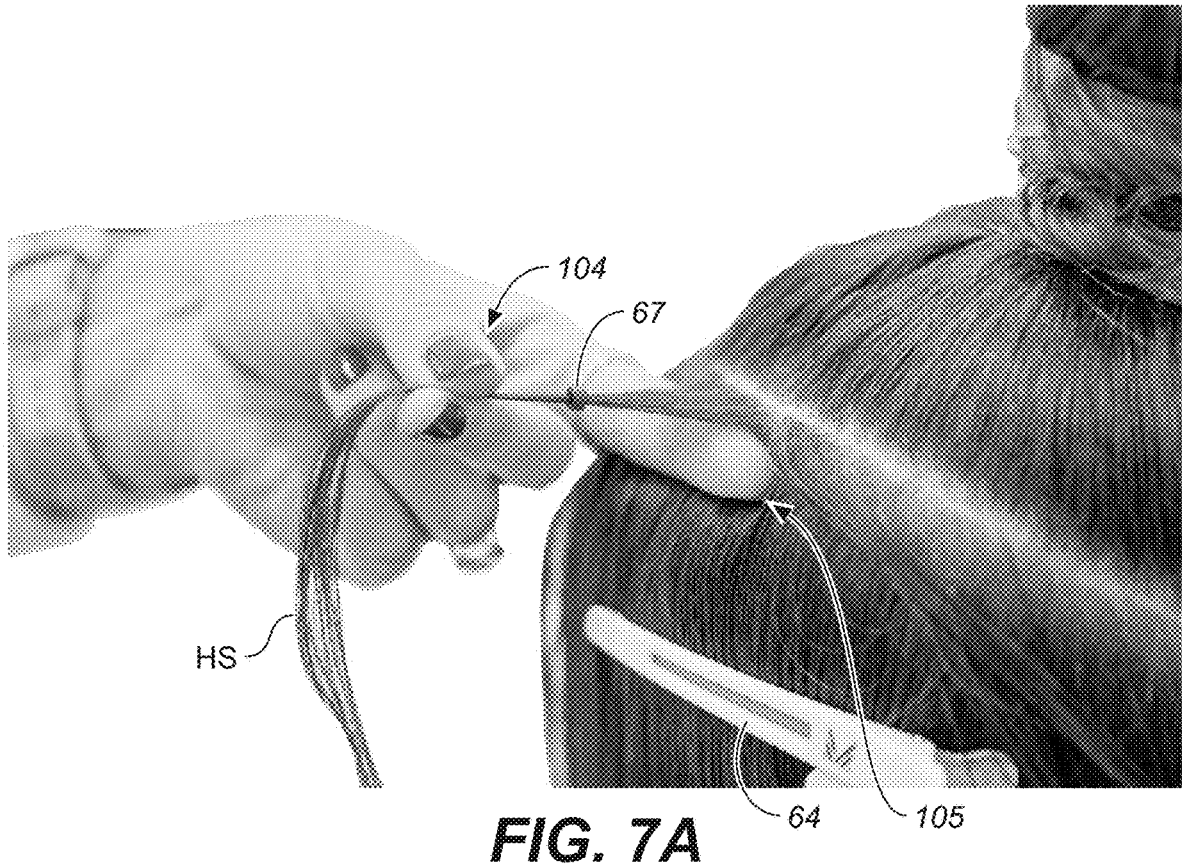
FIG. 7A is a photographic left side view showing a first step in a set of steps for the proper placement of a bead.
Figure 7B:
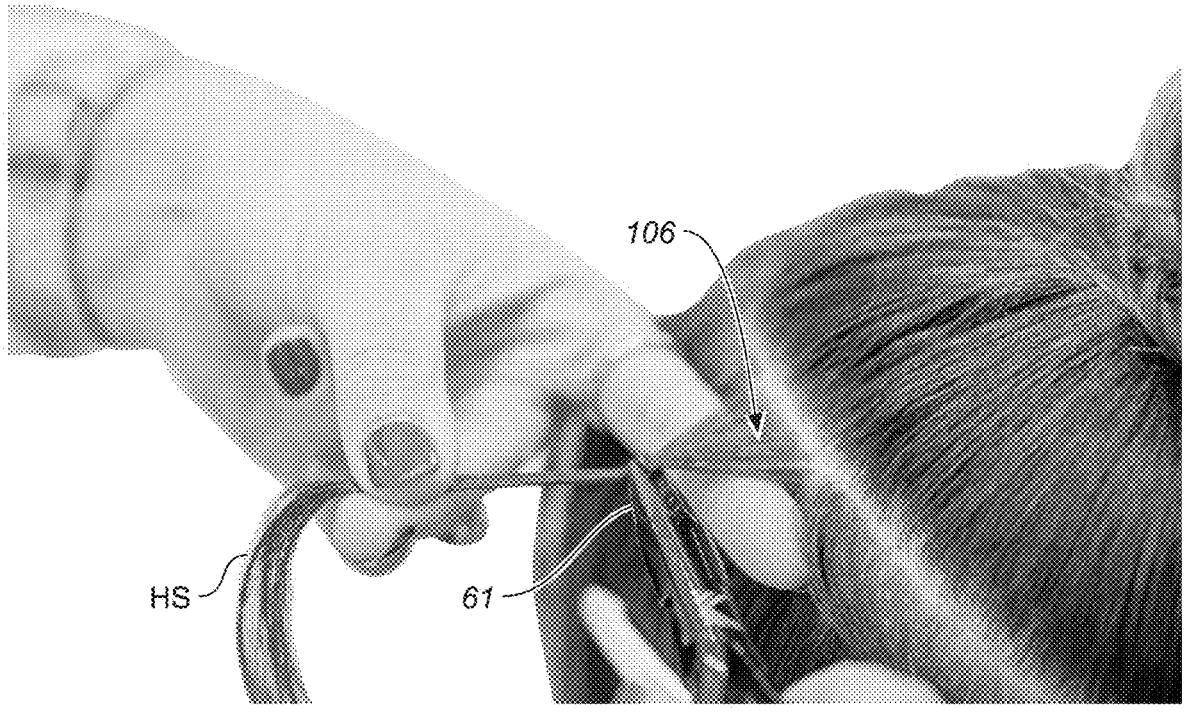
FIG. 7B illustrates a second step thereof.
Figure 7C:
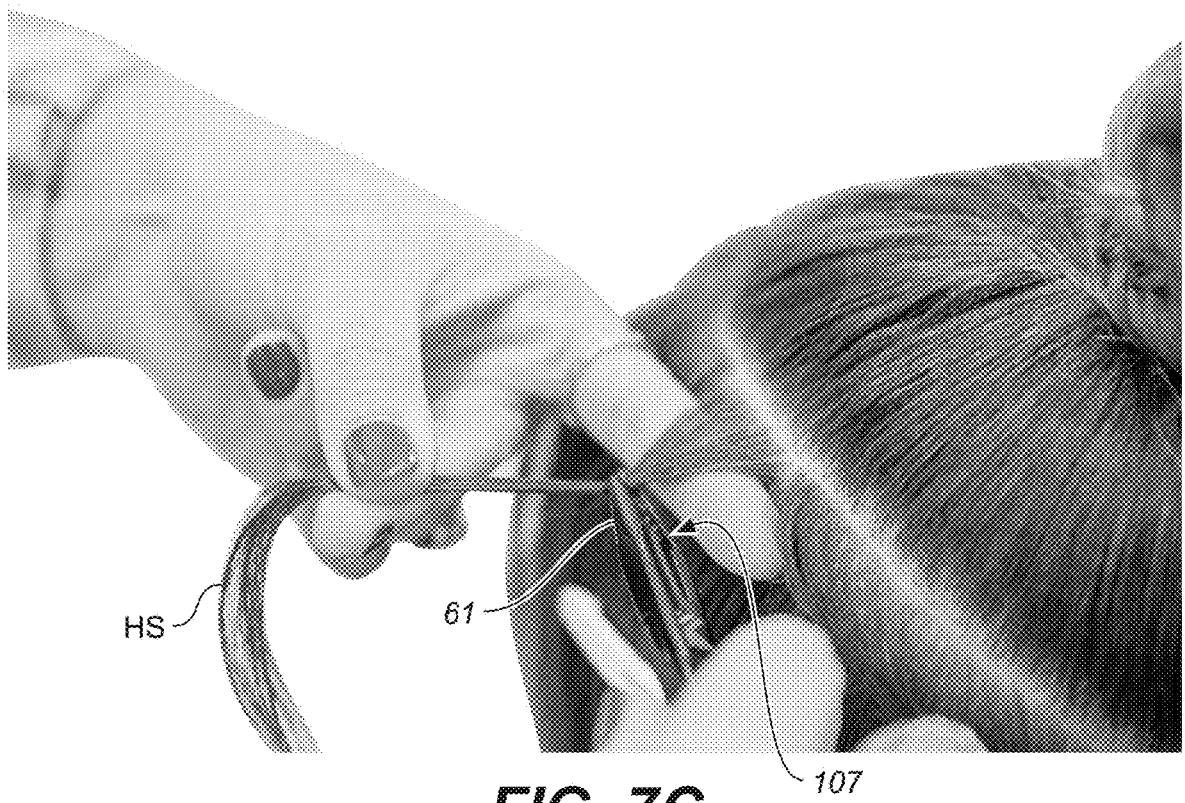
FIG. 7C illustrates a third step thereof.
Figure 7D:
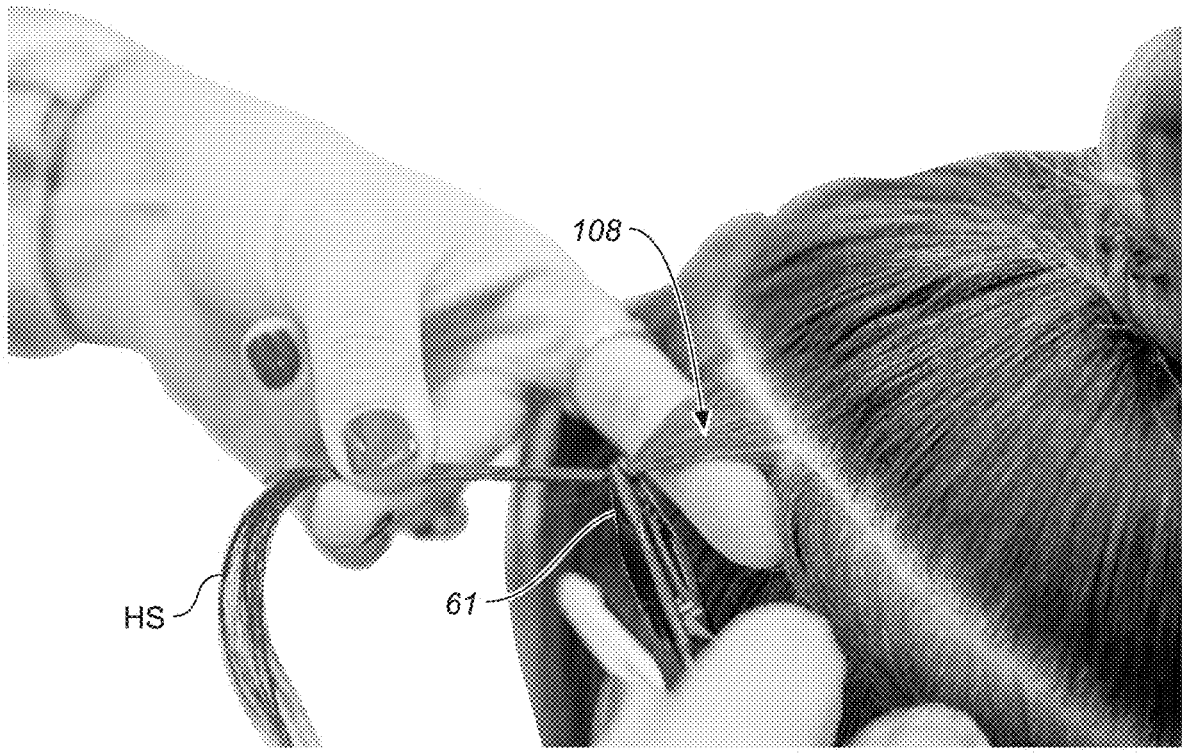
FIG. 7D illustrates a final step thereof.

FIGS. 6A-6I show the tool set required to carry out the inventive method (not including the separator earlier shown and described). FIG. 6A shows a bead closer tool 61; FIG. 6B shows a bead opener tool 62; FIG. 6C shows a bead crimper 63; FIG. 6D shows a cross hair clip 64; FIG. 6E shows a looper tool 65; FIG. 6F shows a spool of cotton thread 66; FIG. 6G shows a set of 5 mm silicone beads 67; FIG. 6H shows two weft clips 68; and FIG. 6I shows a C-curved needle 69.

Figure 8A:
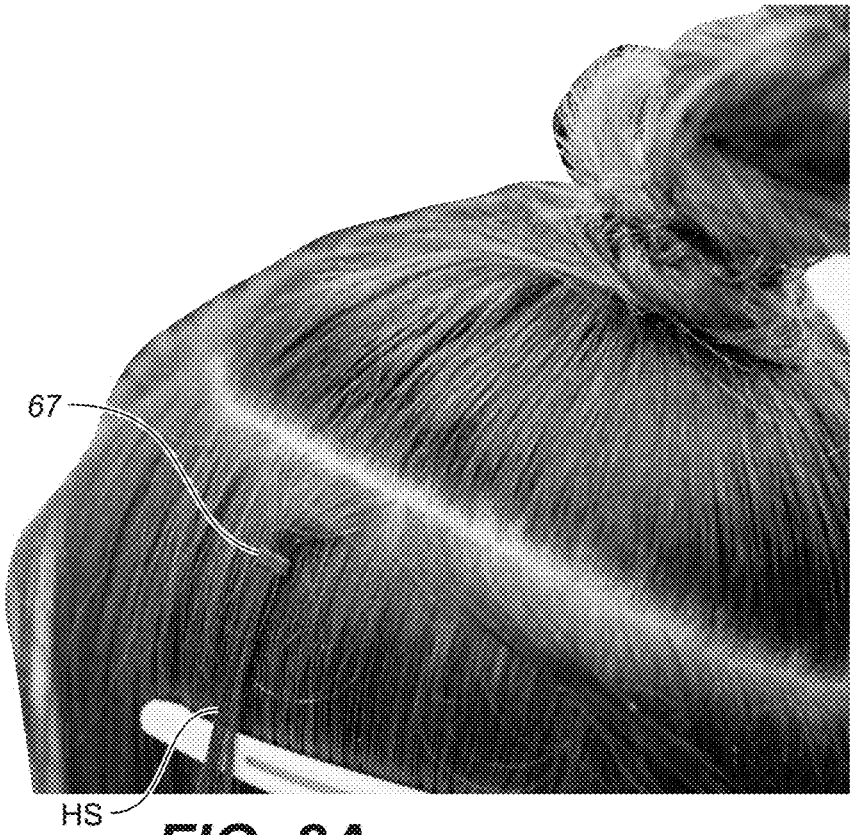
FIG. 8A is a photographic left rear view showing a soft waterfall bead used to create a flexible bead dropout section.
Figure 8B:
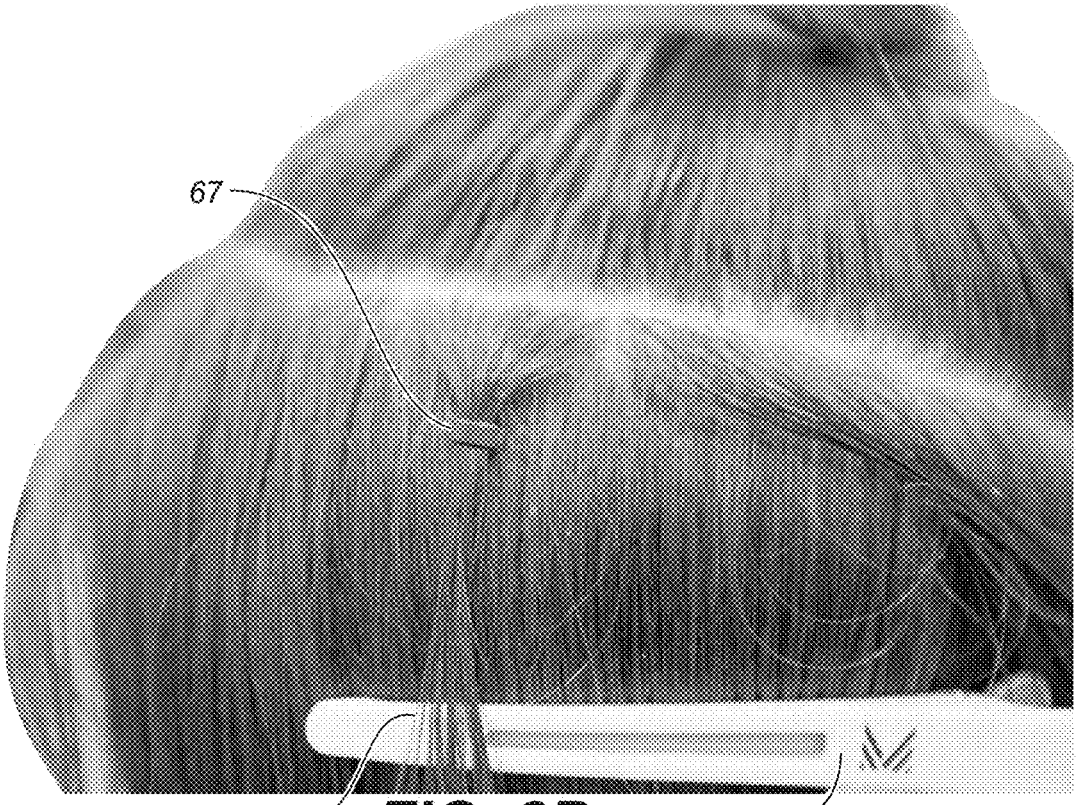
FIG. 8B is a more detailed view thereof.

To position and close the bead as shown in FIGS. 7A-7D, the bead dropout section is placed between the middle finger and thumb, and the strands of hair are pulled to even tension 104; simultaneously, the index finger is placed beneath and parallel to the rectangular section 105. Holding the section at a 90-degree angle, the stylist slides the bead to approximately 1 to 1⅛ inches away from the scalp, keeping the bead centered in the section 106. Maintaining the 90-degree angle on the section, with the opposite hand, the stylist holds the bead with the bead closure pliers and turns the pliers to a 45-degree angle 107. Gentle pressure is applied downwards with the bead closure pliers to create a soft bend in the bead dropout section 108. This soft, waterfall bend shown in FIG. 8 creates flexibility in the bead dropout section, preventing unwanted tension on the scalp or hair follicle.

Figure 9A:
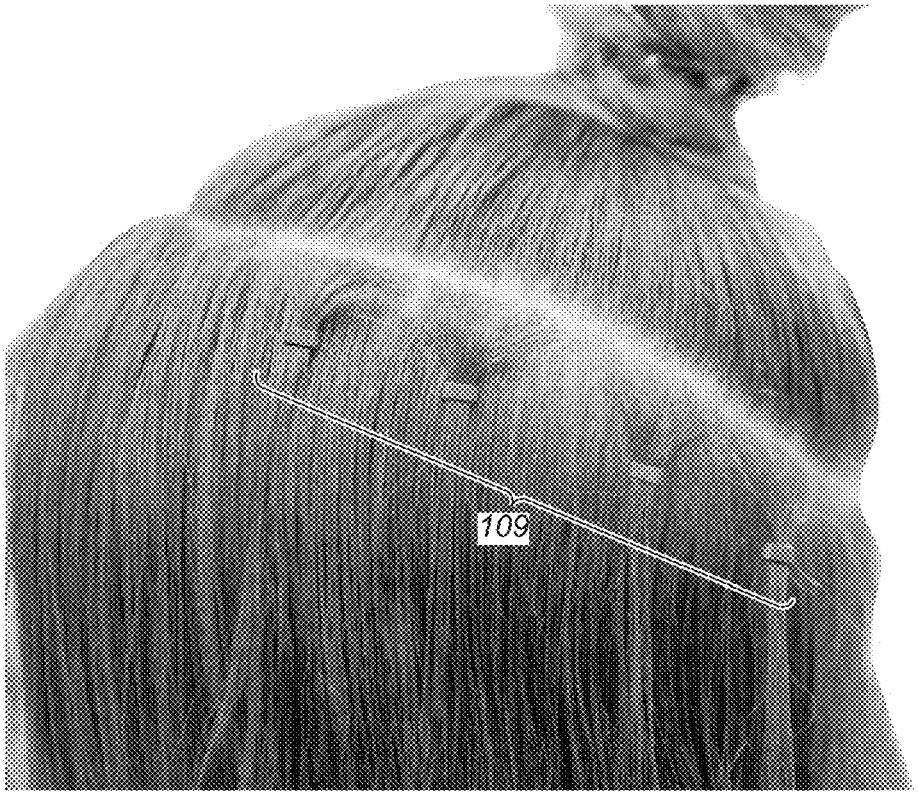
FIG. 9A illustrates the minimum number of beads needed on each side of a row section.
Figure 9B:
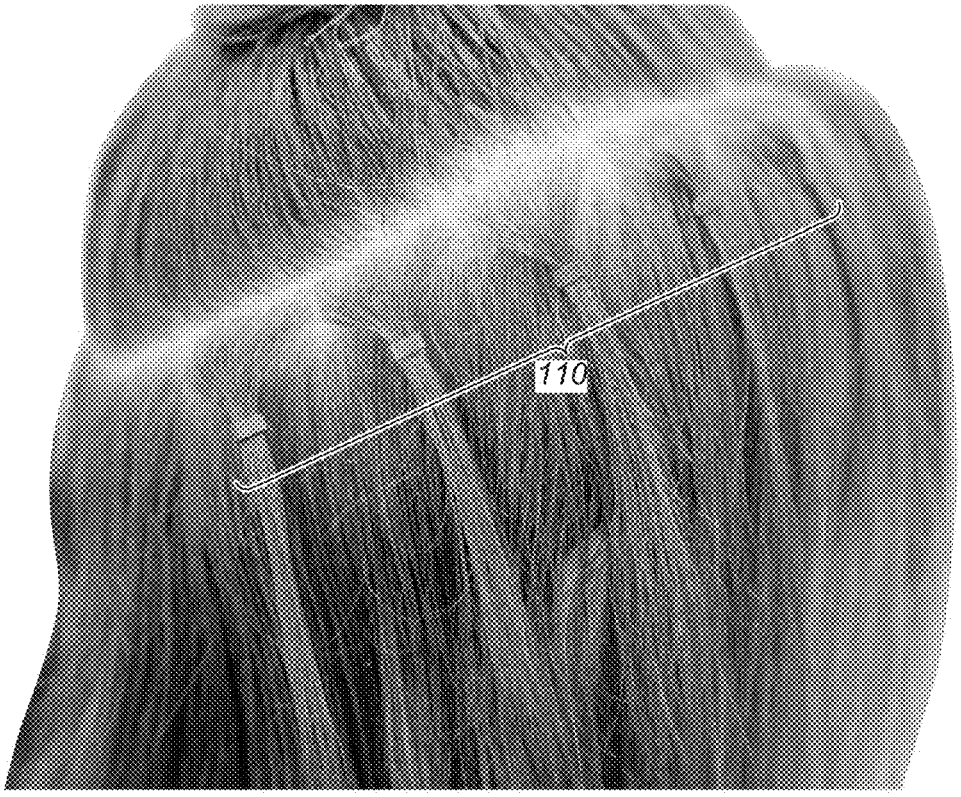
FIG. 9B illustrates the maximum number of beads on each side of a row section.
Figure 9C:
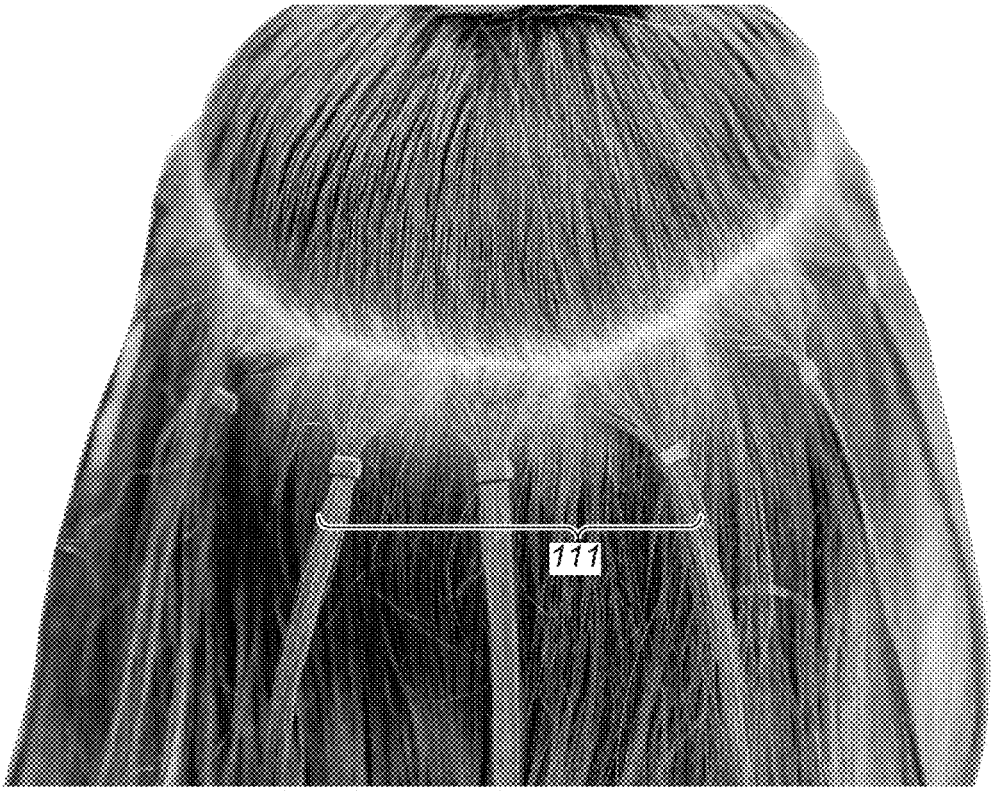
FIG. 9C shows the number of beads used on the back of each row section.
Figure 10A:
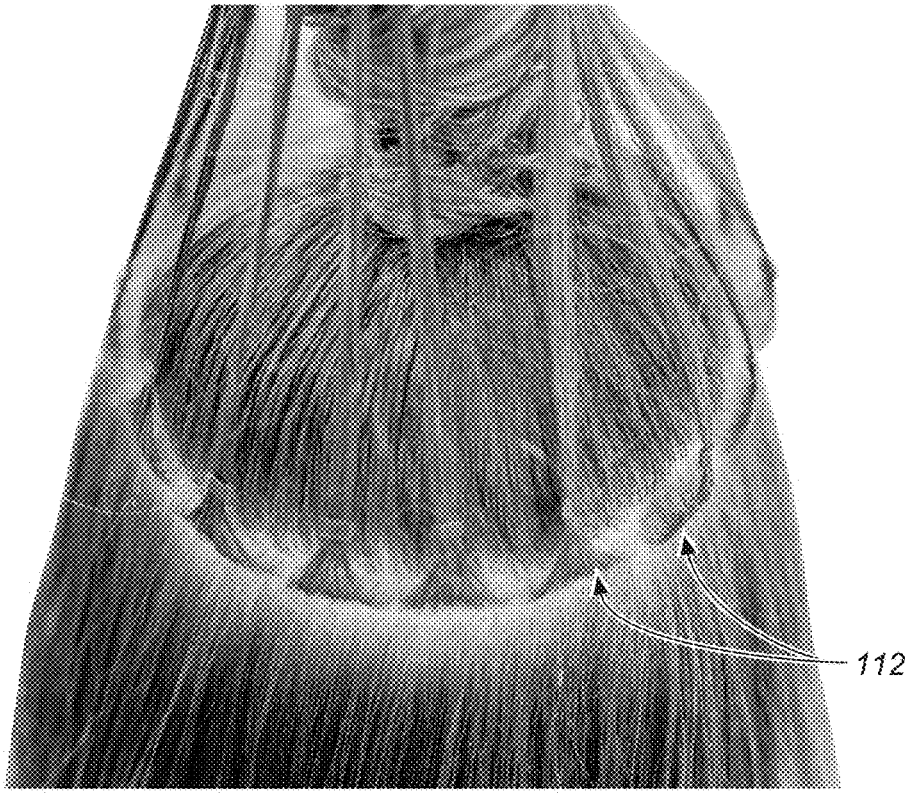
FIG. 10A illustrates how to pull up bead dropout sections to secure wefts underneath the dropout sections.
Figure 10B:
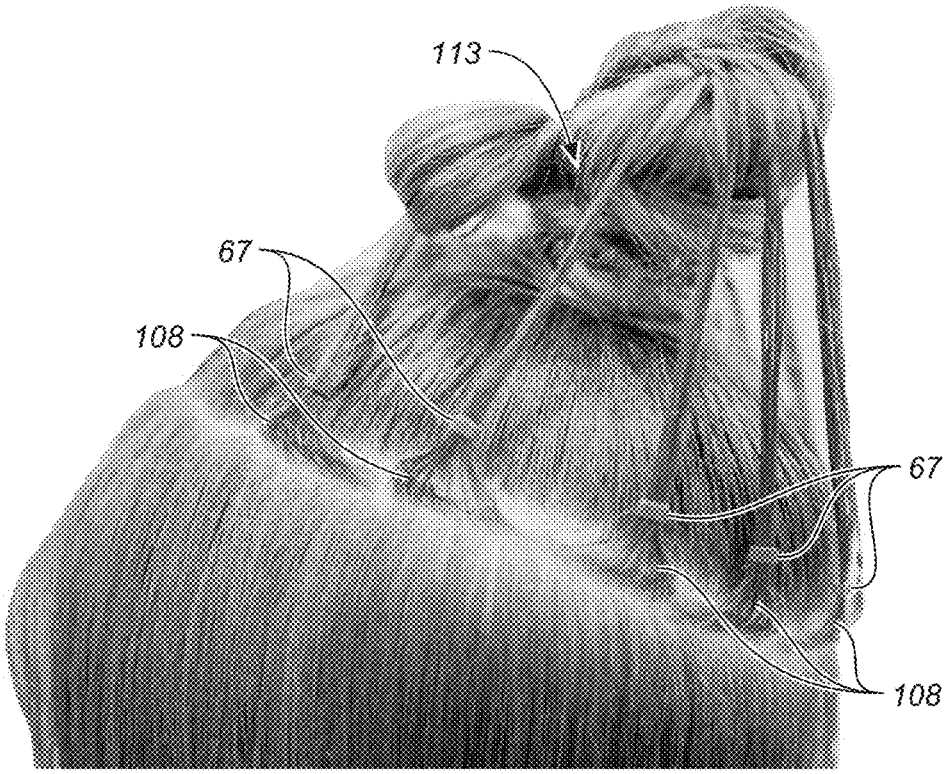
FIG. 10B shows how the dropout sections are secured with a clip.

The stylist continues to create 1⅛-inch bead dropout sections on the left and right sides of the client's head as pictured in FIGS. 9A-9C. There will be a minimum of four 109 [FIG. 9A] and a maximum of five 110 beads [FIG. 9B] on each side of the head. Once the beads are placed on each side of the head, three evenly spaced sections are placed at the back of the head 111 [FIG. 9C]. Having completed the first row, all the bead dropout sections are lifted 112 (as illustrated in FIGS. 10A-10B) and secured to the top of the head with a clip 113 [FIG. 10B].

Referring now to FIGS. 11A-11E, wefts are secured below the bead dropout sections in the following manner. Starting on the left side of the head, one weft 114 is pinned under the beads starting at a left corner of the first bead dropout section with a horizontal clip 68 [FIG. 11A]. Once the corner is secured, the stylist works toward the right of the head, securing the weft 114 by placing clips 68 vertically through the bead dropout sections 108 [the method step denominated 115, FIG. 11B]. The first bead dropout section 108*a* is lain atop the weft in its natural state and the weft is clipped slightly through the sections or underneath the beads [the method step denominated 116]. If the weft is clipped through the rectangular bead dropout section, the stylist will clip on the same side of the rectangle as the direction the stylist is moving along the head [this step denominated 117, FIG. 11C].

Figure 11A:
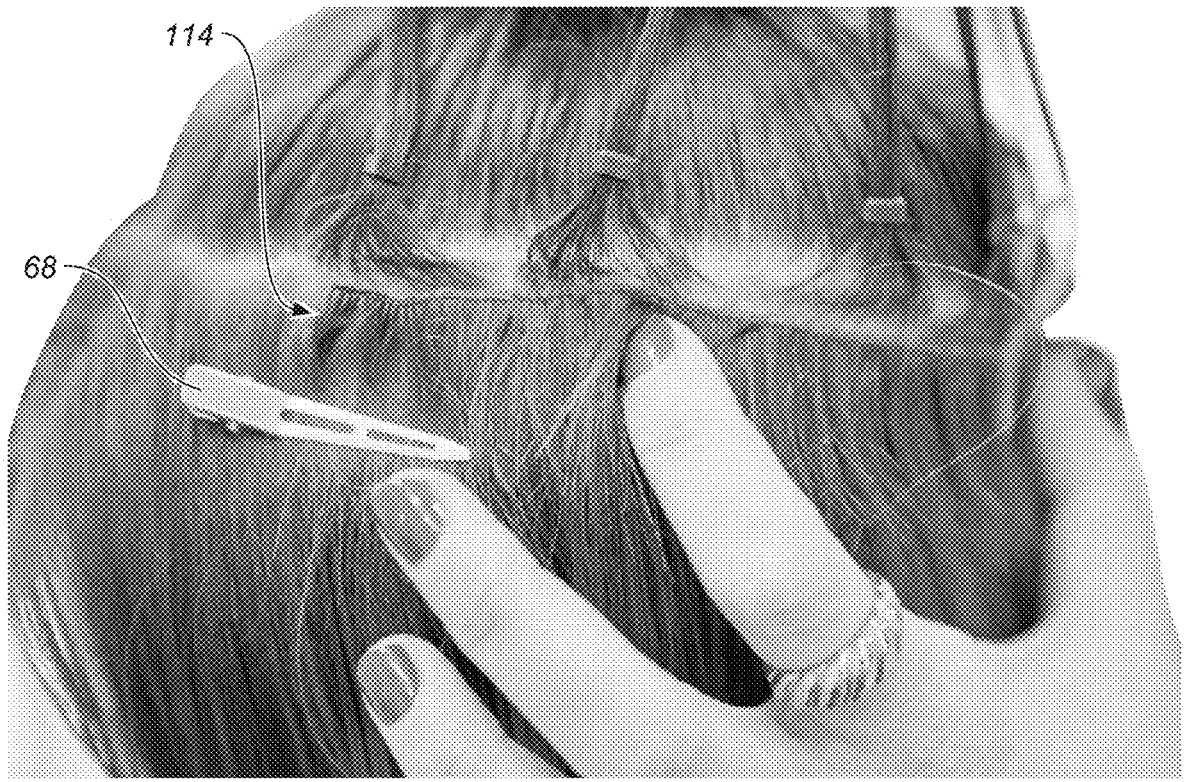
FIG. 11A illustrates the first method steps involved in securing wefts below bead dropout sections.
Figure 11B:
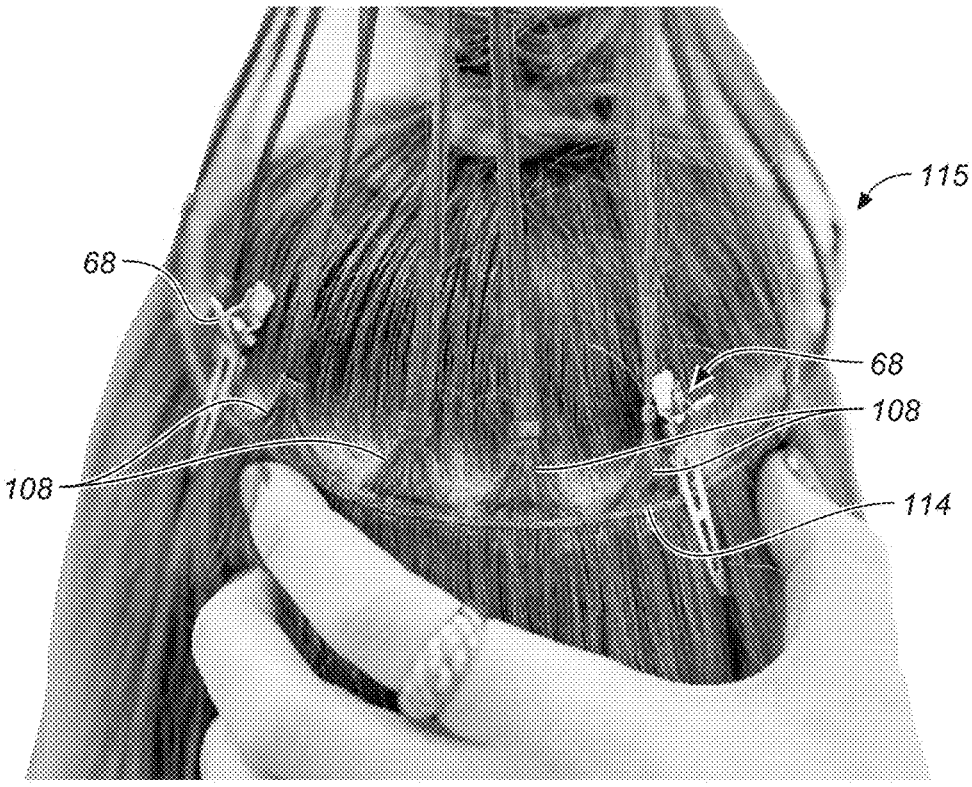
FIG. 11B illustrates the same process showing clip placement.
Figure 11C:
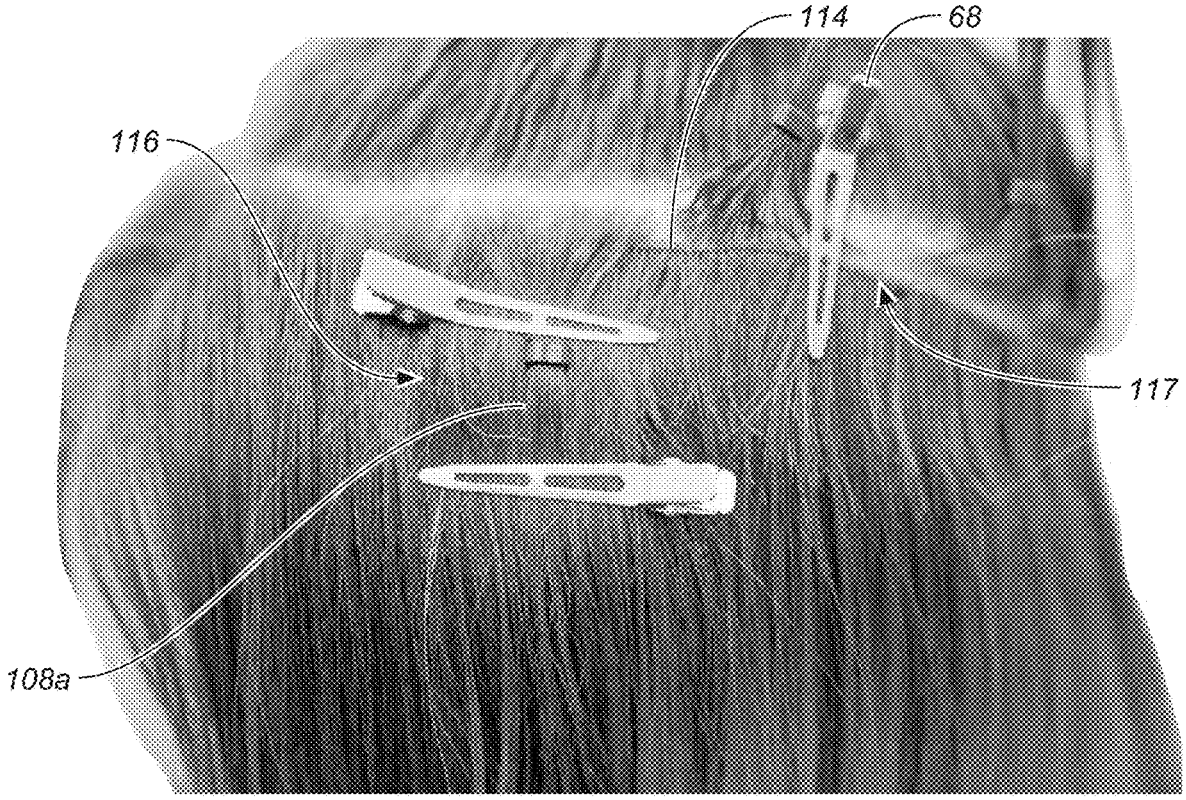
FIG. 11C illustrates the same process showing clip orientation on placements.
Figure 11D:
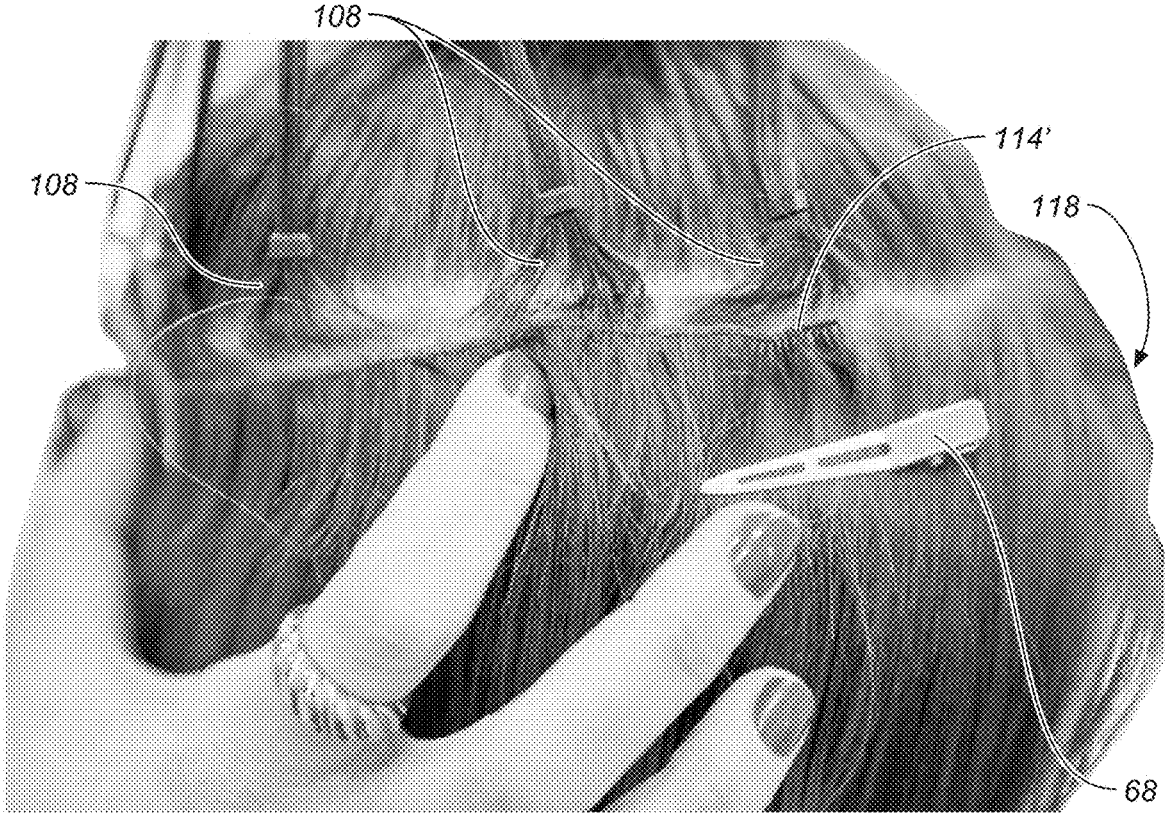
FIG. 11D illustrates progression in securing the weft.
Figure 11E:
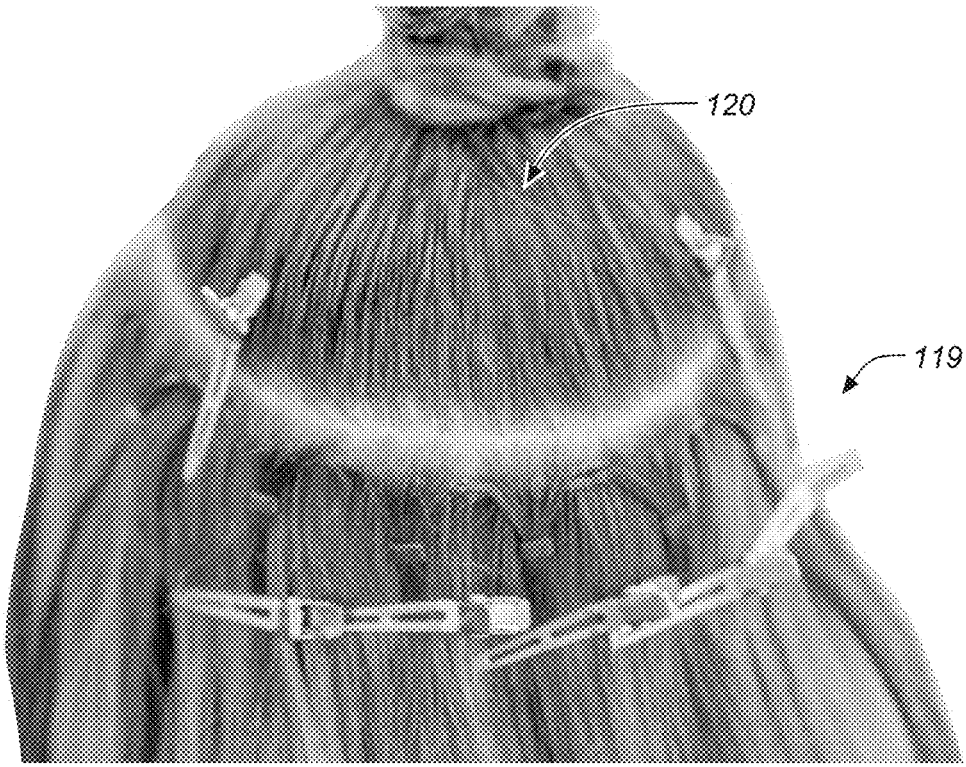
FIG. 11E illustrates wefts placed under the beads.

Repeating on the right side of the head, one more weft 114' is secured under the bead drop out sections 108, starting at the right corner, with a horizontal clip 68 [the step denominated 118, FIG. 11D]. The stylist continues 119 laying the bead dropout sections atop the weft and securing the weft, working towards the left of the head, using the horizontal clips to hold down the bead dropout sections [FIG. 11E]. A maximum of two wefts are placed underneath the beads, and only one if it can reach entirely around the head 120 [FIG. 11E].

Figure 12A:
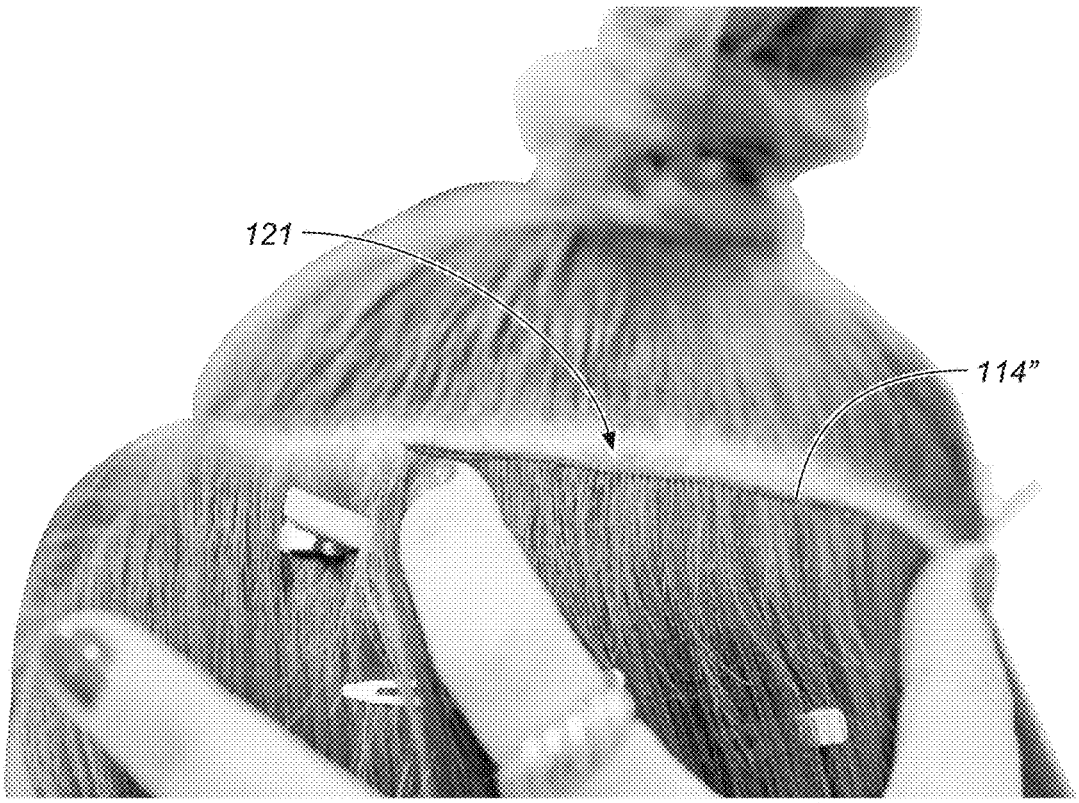
FIG. 12A illustrates a first step in how to secure wefts above the bead dropout sections after the lower wefts have been placed.
Figure 12B:
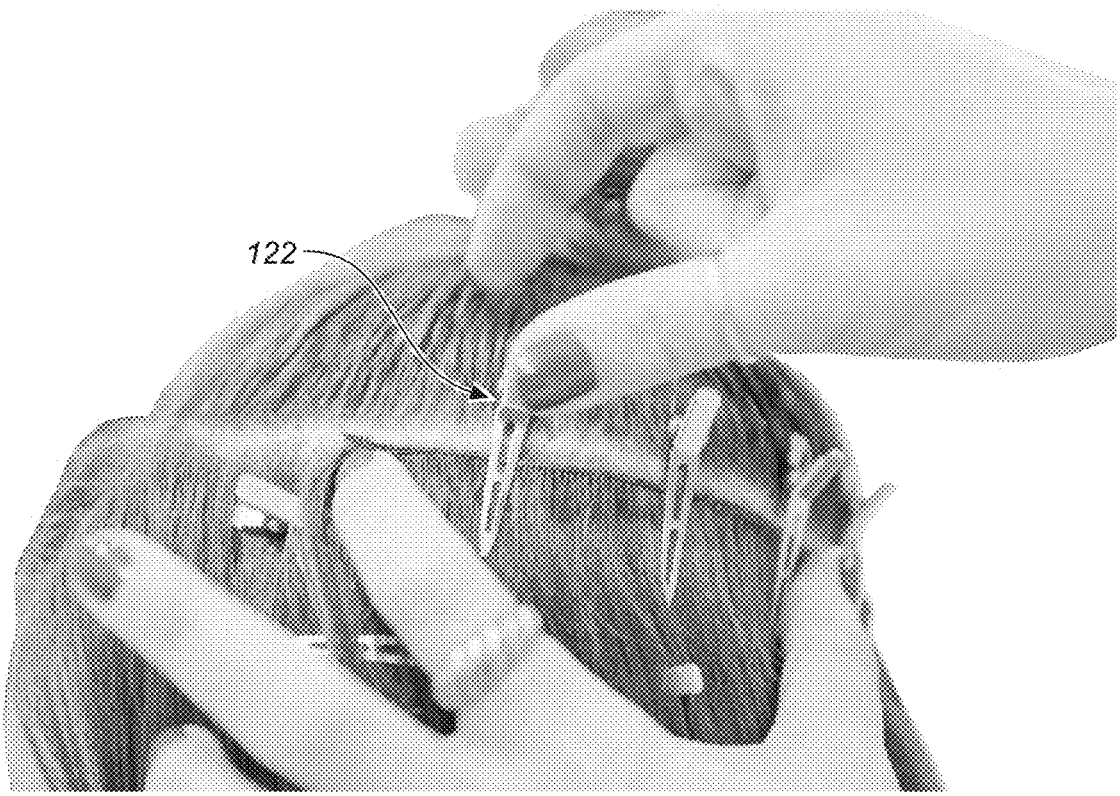
FIG. 12B illustrates a second step thereof.
Figure 12C:
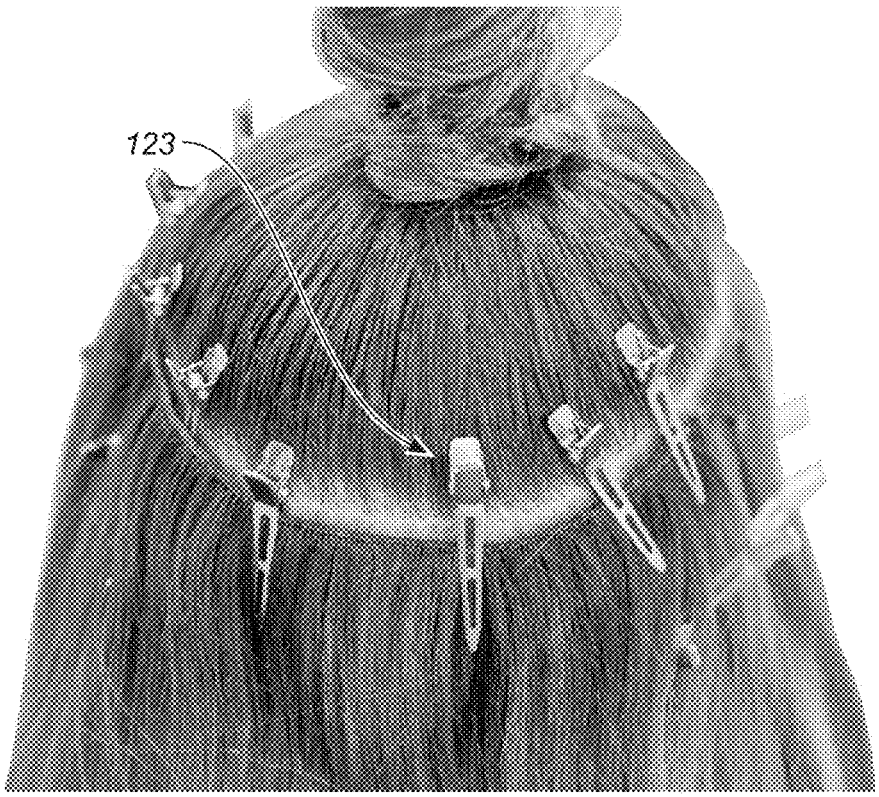
FIG. 12C illustrates a third step thereof.
Figure 12D:
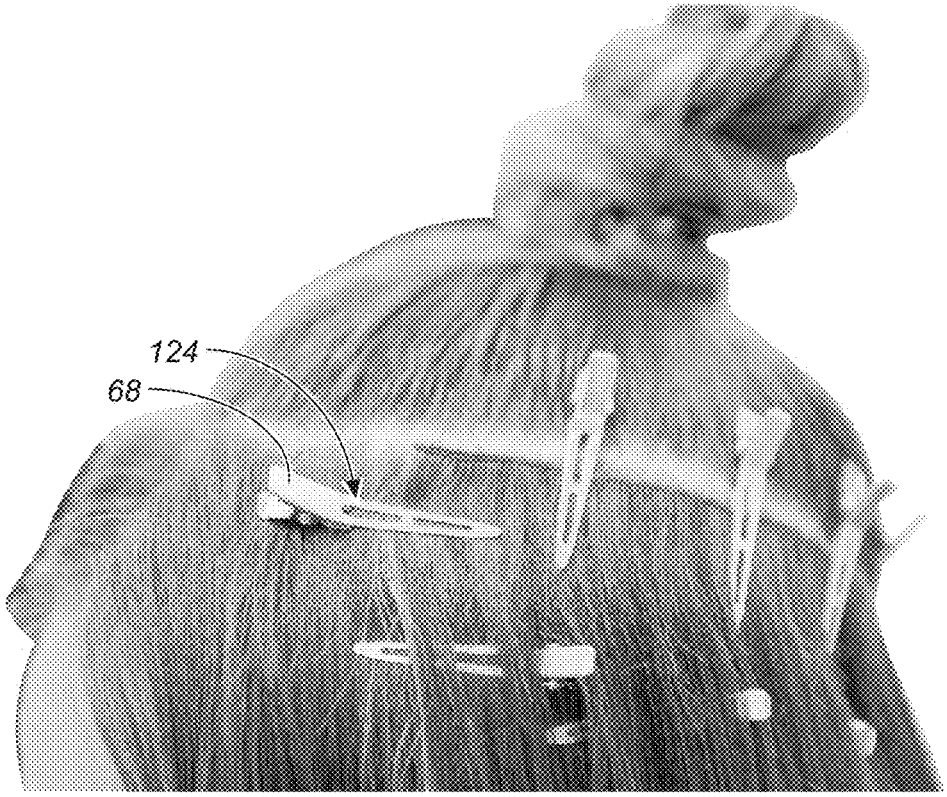
FIG. 12D illustrates a fourth step thereof.
Figure 12E:
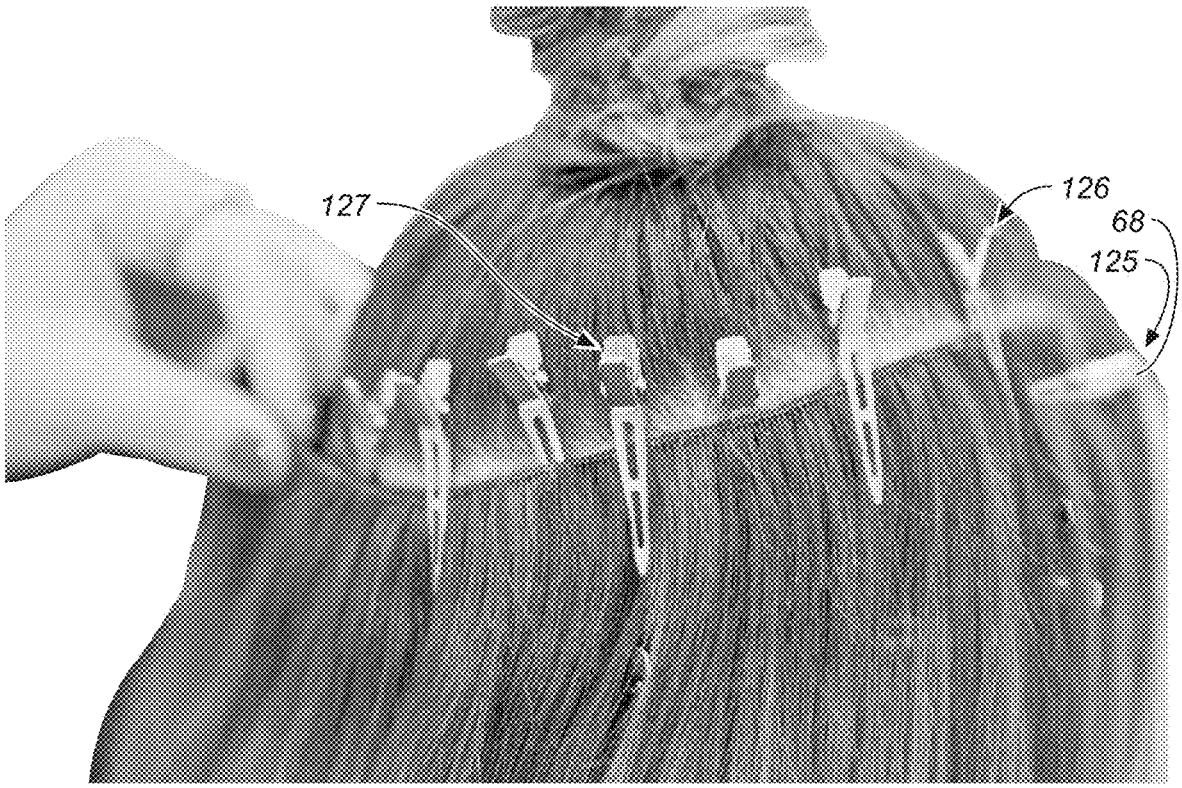
FIG. 12E shows the progression of clip placements for securing the wefts above the bead dropout section.
Figure 13A:
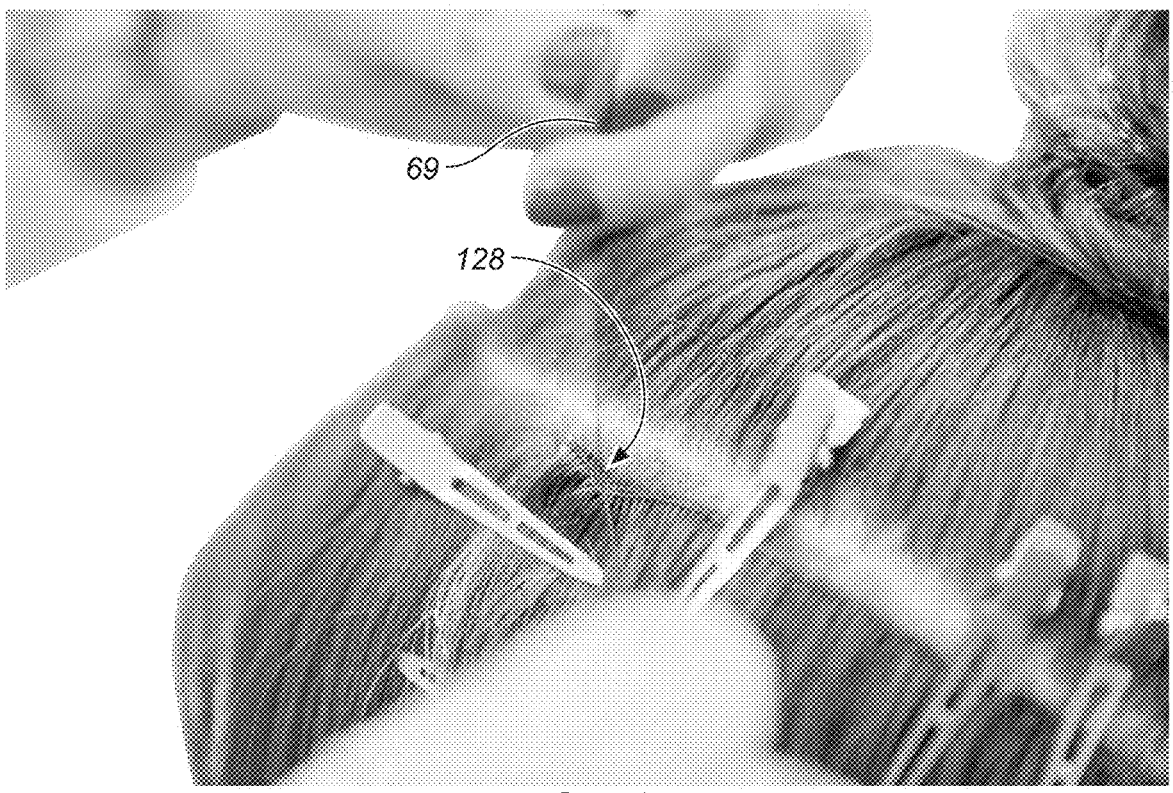
FIG. 13A illustrates a first phase in stitching wefts together to create a zipper-like seal using a C-curve needle.
Figure 13B:
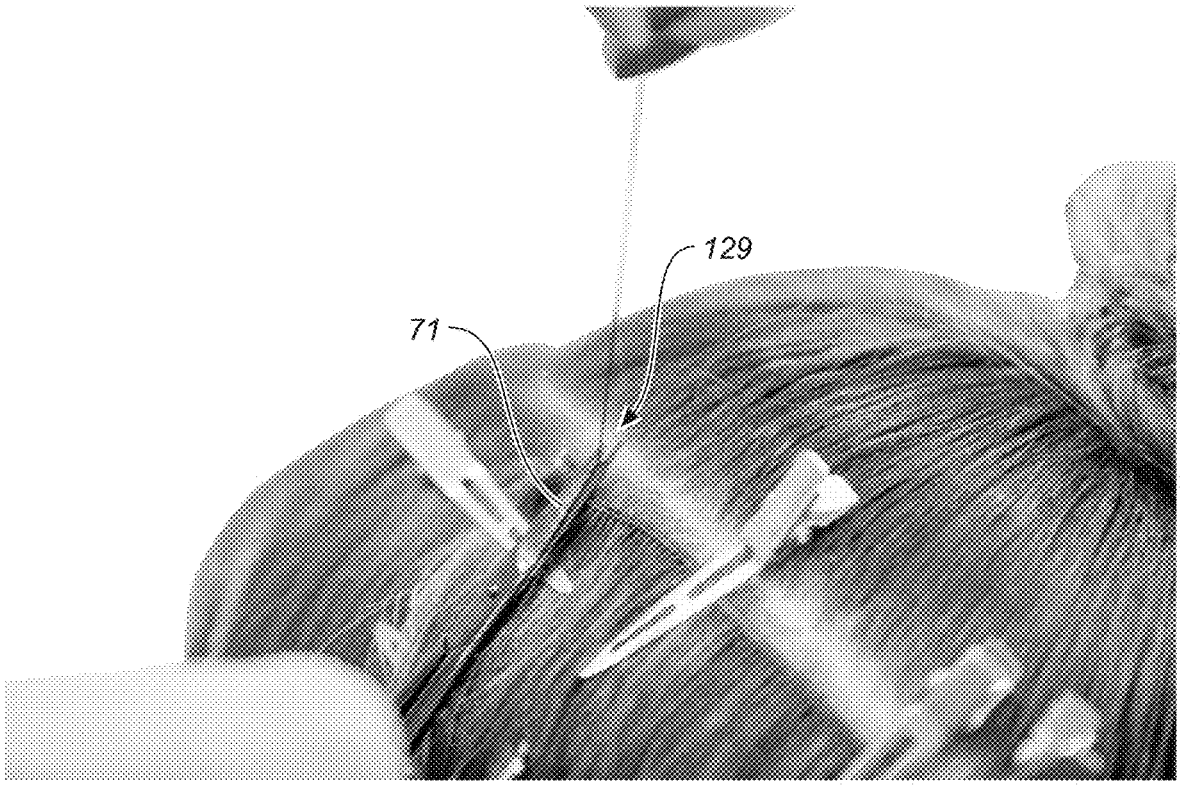
FIG. 13B illustrates the second phase thereof.
Figure 13C:
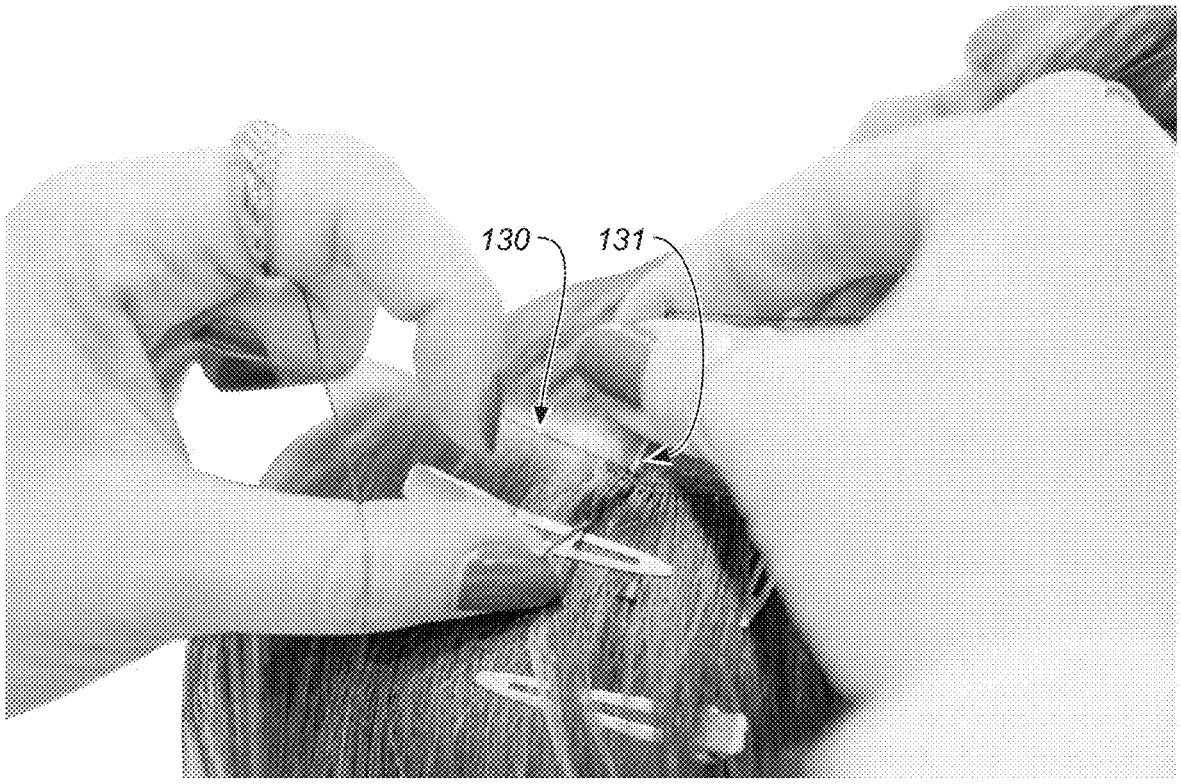
FIG. 13D illustrates the third phase thereof.
FIG. 13E illustrates the phase involving locking the stitch.
Figure 13D:
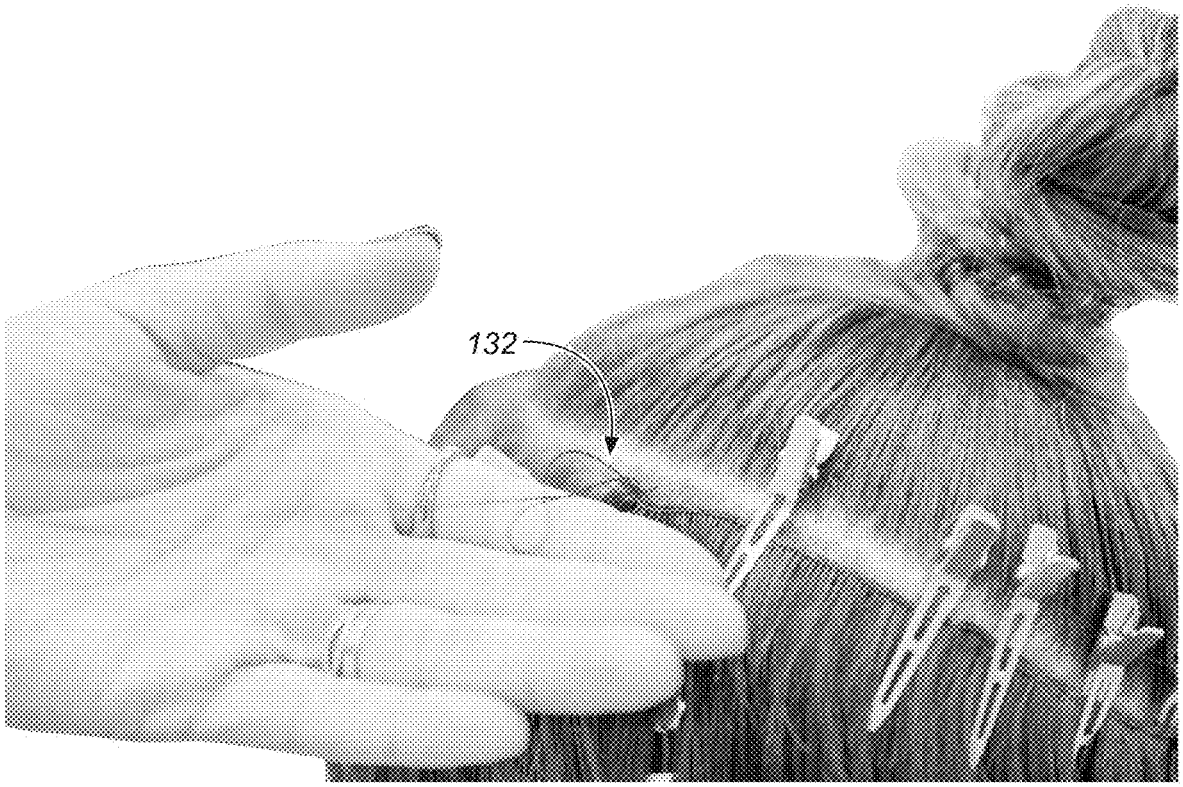
Figure 13E:
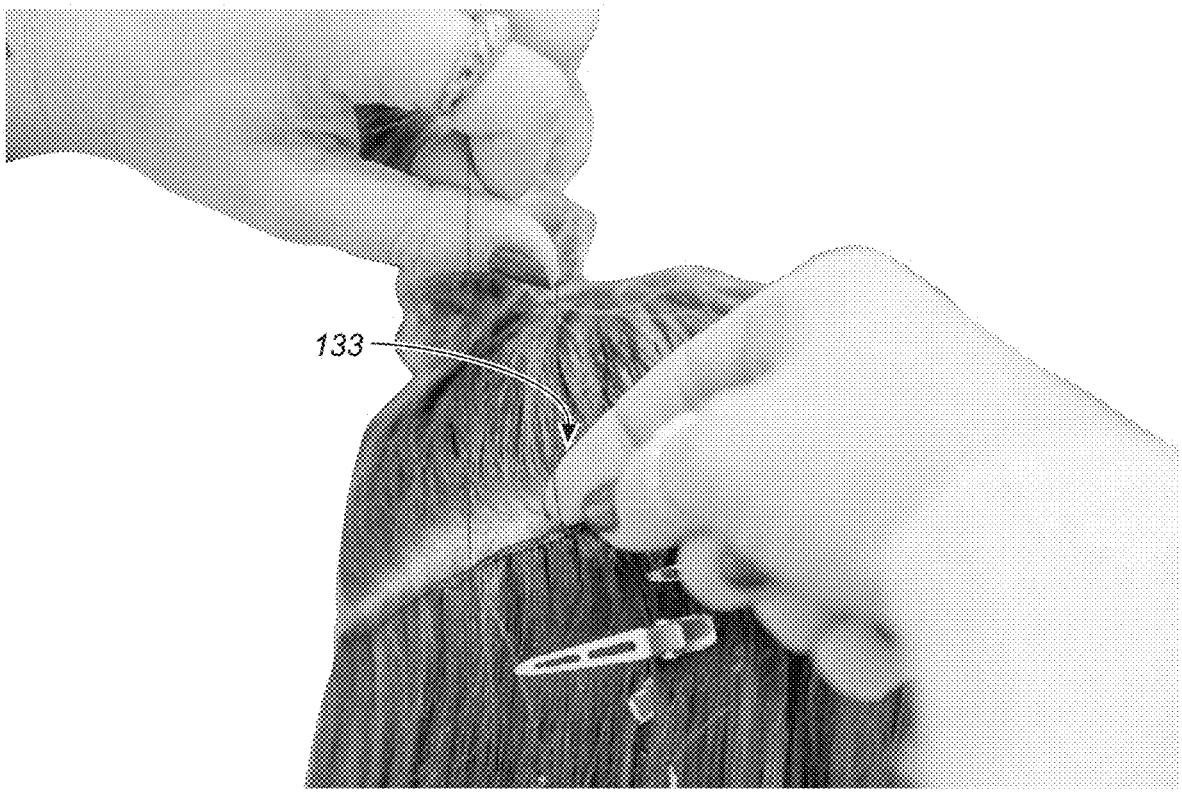

Once the one or two wefts are secured below the bead dropout sections, an outer weft 114" is secured on top of the sections as shown in FIGS. 12A-12E. The stylist places 121 this outer weft 114" slightly higher than the underlying wefts to ensure the wefts below 114, 114' are concealed during stitching. The stylist begins by placing clips 68 vertically through each bead dropout section (the step denominated 122 in FIG. 12B) and continues placing vertical clips to secure the weft, working toward the right of the head to create a level annular row of clips 123 [FIG. 12C]. If the outer weft 114" is clipped through the rectangular bead dropout section, the stylist will clip on the same side of the rectangle as the direction the stylist is moving along the head. Once the outer weft is secured, one horizontal clip is placed on the right corner, pointing left [step 124, FIG. 12D], and one horizontal clip is placed on the left corner, pointing right [step 125. FIG. 12E]. A second clip 68 is vertically placed on the right side of the head [step 126, FIG. 12E], and subsequent clips are vertically placed to secure the weft working toward the left side of the head [step 127, FIG. 12E]. Depending on the desired fullness, each row will have between four and eight wefts.

The stylist creates a zippered seal by stitching the wefts together using a C-curved needle 69 and cotton thread for stitching in the manner outlined in FIGS. 13A-13E. The stylist secures the first stitch with three knots in the left corner section, ¼ inch from the left end of the section (step 128, FIG. 13A]. Using mini scissors 71, the tail of the tread is cut after the knots have been tied [step 129, FIG. 13B]. Leading the thread to the left, the C-curved needle 69 is placed ⅛ inch from the left end of the section, through the top of the bead dropout section, and behind all the wefts [step 131, FIG. 13C]. The stylist then pulls the C-curved needle up and through the circle section created by leading the thread to the left [step 132, FIG. 13D]. The stylist creates a lock stitch by placing the index finger on top of the weft line and against the scalp, pulling the tread up and over the center of the head, and pushing the knot down with a thumb to the top of the wefts [step 133, FIG. 13E].

The stitching pattern employed in the present invention is completed before beads in the waterfall bead sections are moved closer to the scalp. This allows the stylist to eliminate tension as well as to adjust or replace beads once the installation is completed. It proceeds as follows: A corner stitch is created as illustrated in FIGS. 14A-14E. The stylist again leads the string to the left and places the C-curve needle 69 through the bottom of the bead dropout section, behind all the wefts, ⅛ inch from the left end of the section [step 135, FIG. 14A]. Taking the thread to the right behind the C-curved needle, and wrapping back towards the left, the stylist wraps thread around the back of the C-curved needle [step 136, FIG. 14B]. The C-curved needle is then pulled up and through the circle section created by leading the thread to the left [step 137, FIG. 14C]. To create a lock stitch, the knot is pushed down to the top of the wefts while the string is pulled outward at a 90-degree angle [step 138, FIG. 14D]. The wefts will not go to the end of the corner section and must start ⅛ inch behind the left corner section [step 139, FIG. 14E].

Figure 14A:
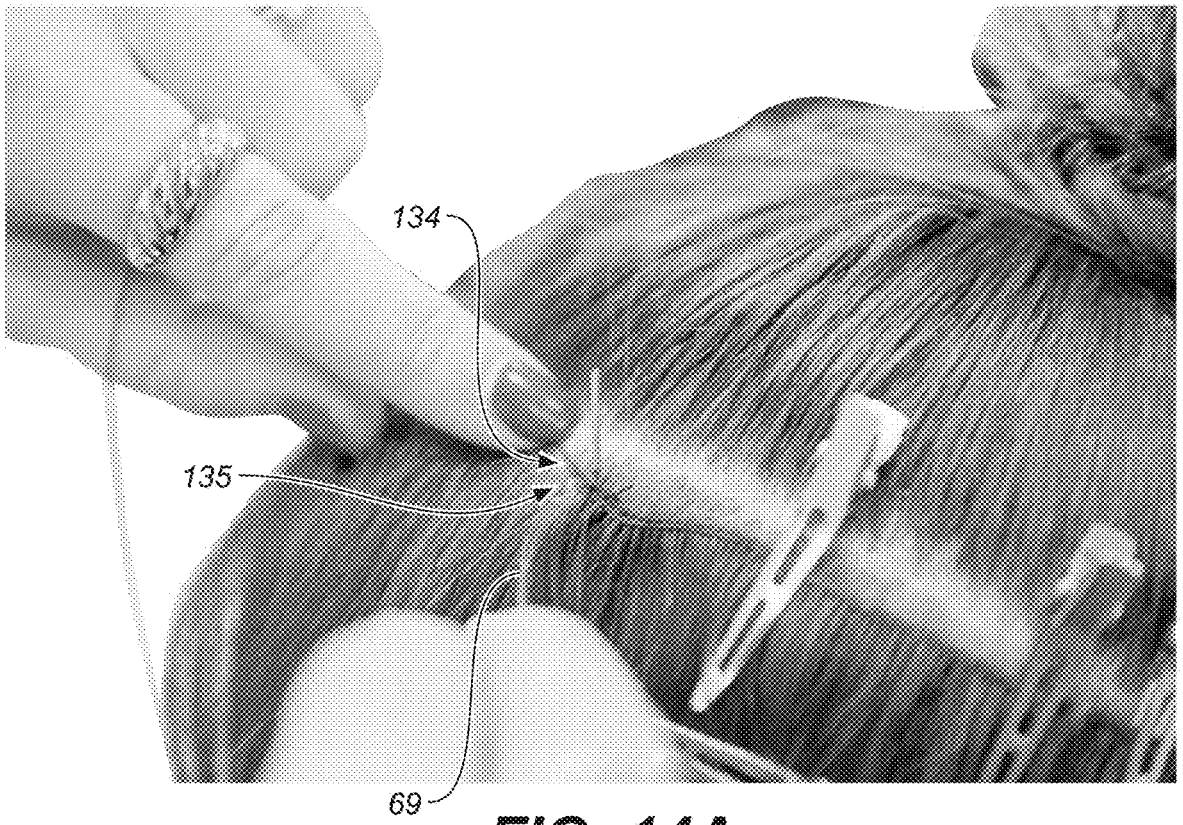
FIG. 14A is the first in a series of illustrations showing how to execute a corner stich.
Figure 14B:
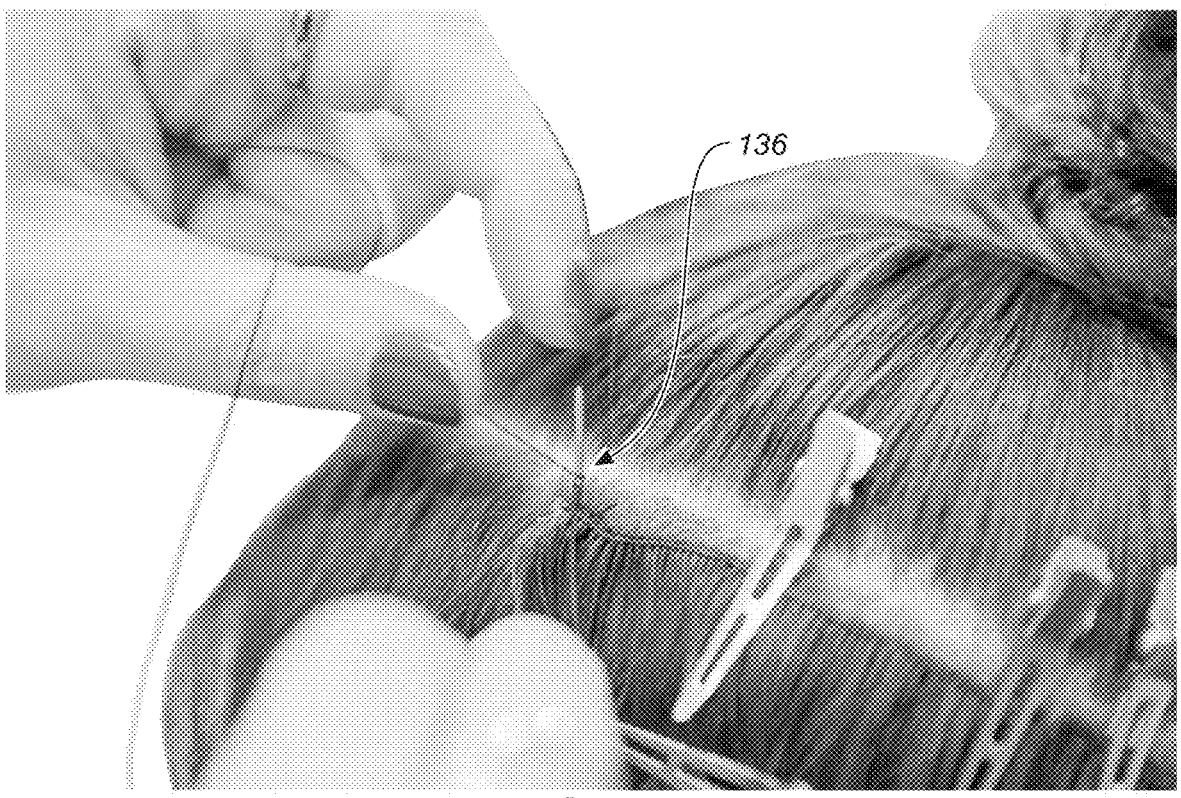
FIG. 14B shows this process continued.
Figure 14C:
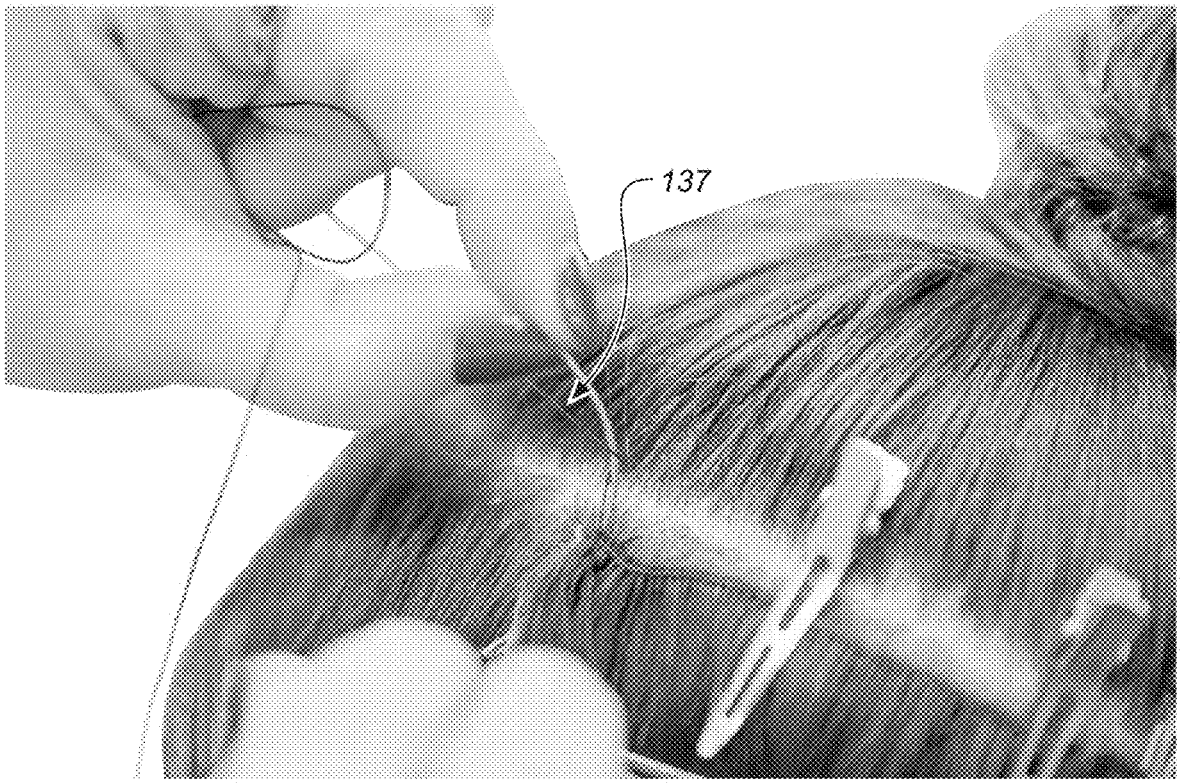
FIG. 14C illustrates yet further progress in the corner stitch.
Figure 14D:
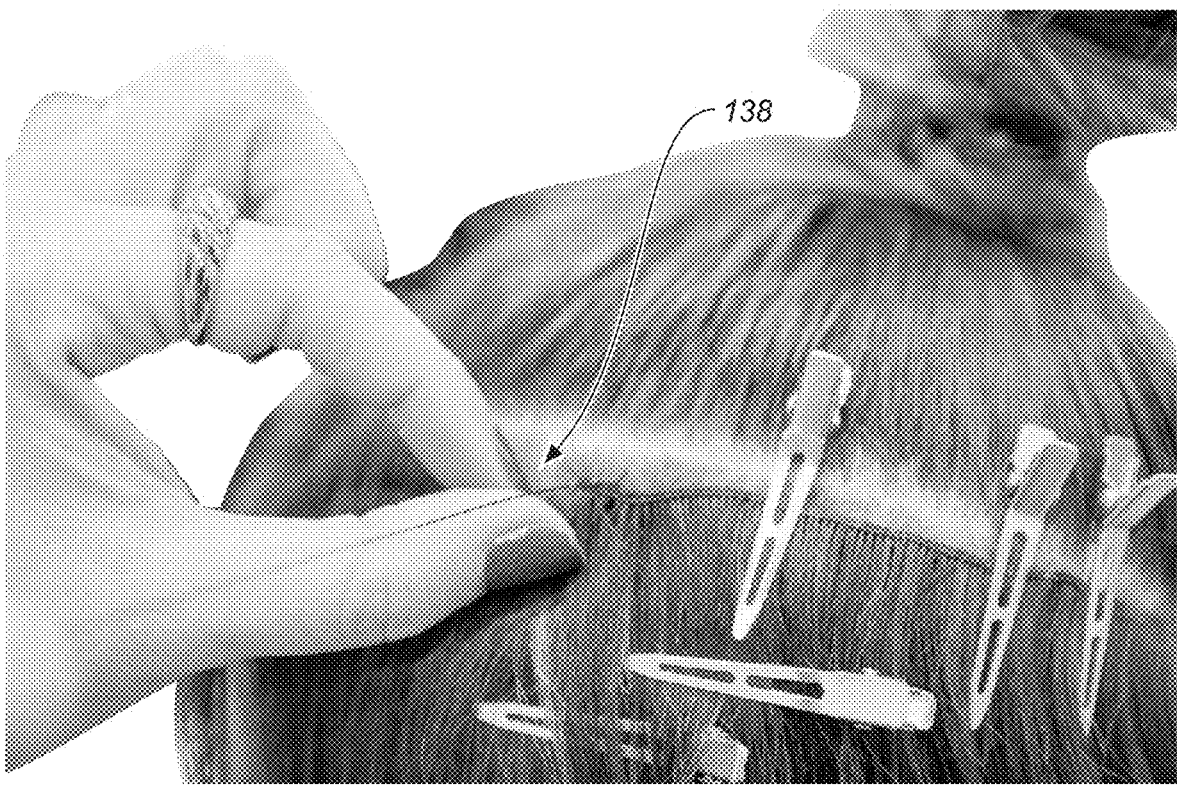
FIG. 14D illustrates how the corner stitch is locked.
Figure 14E:
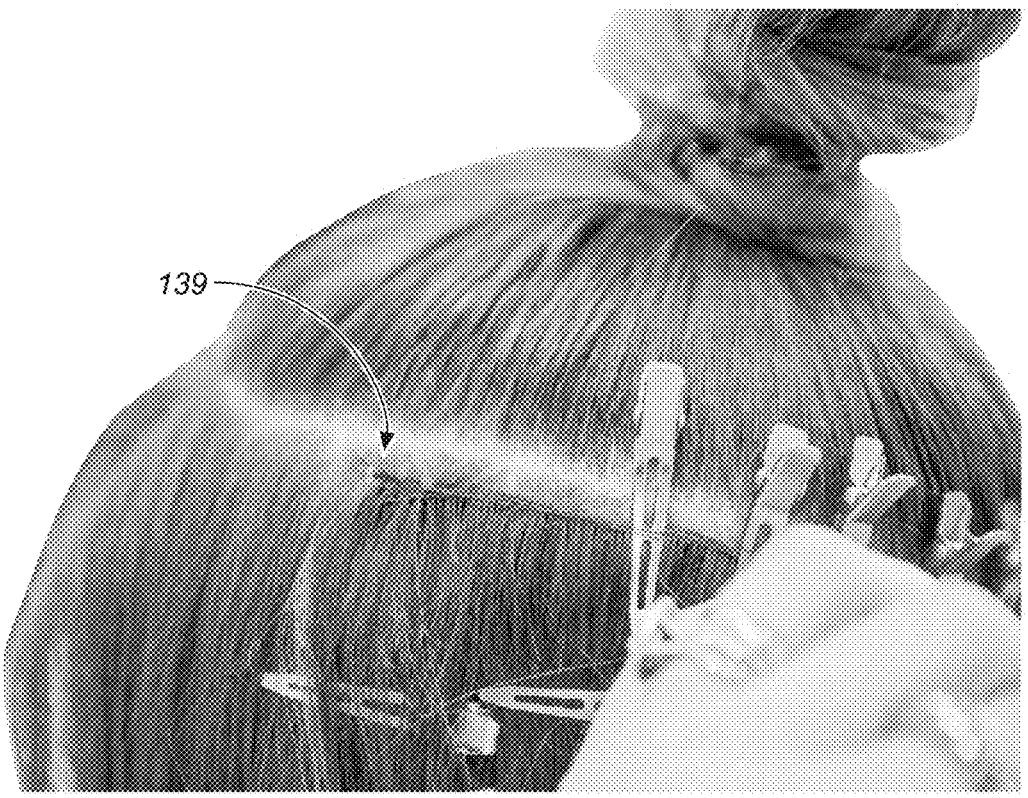
FIG. 14E illustrates location of weft placement at the corner stitch.
Figure 14F:
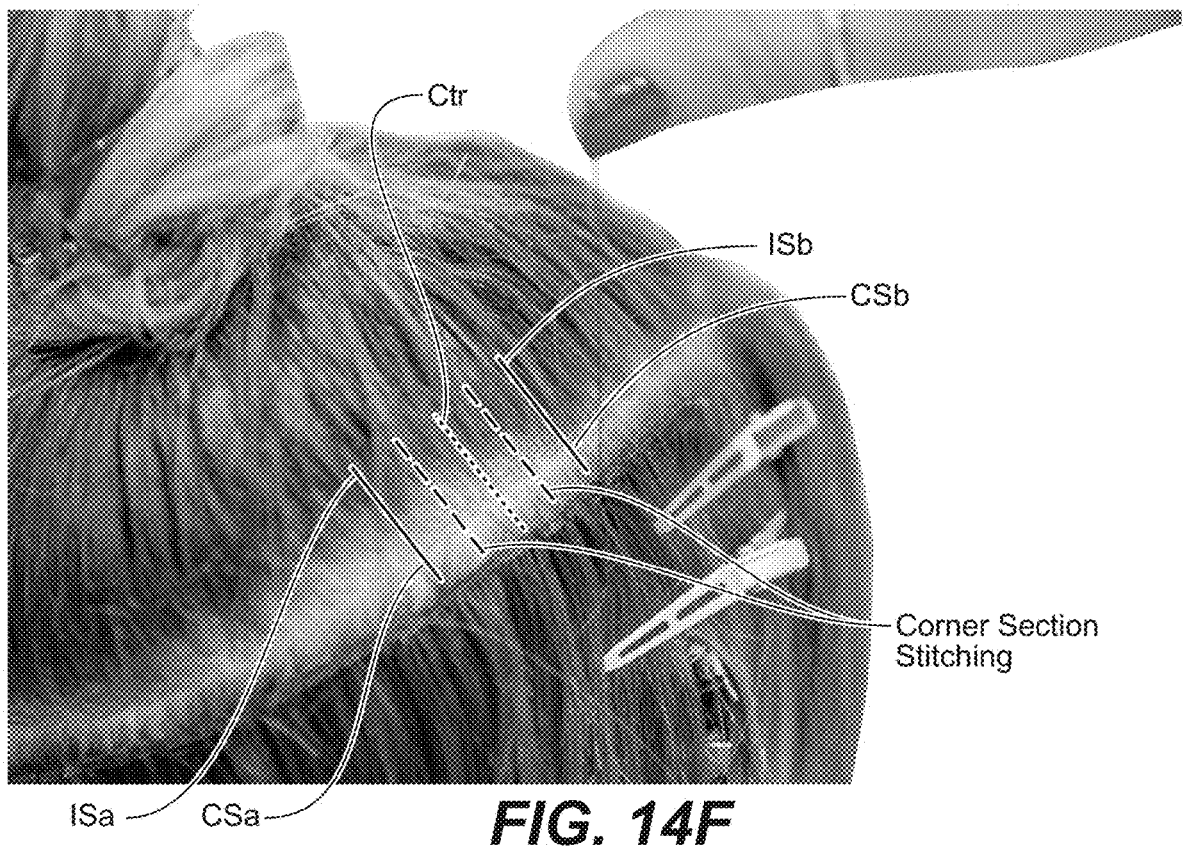
FIG. 14F illustrates where stitches are placed through a section row.

The stylist will continue the stitching pattern, as noted in FIG. 14F, as follows: one intermediate section stich ISa placed between the dropout section, one corner stitch with a lock stitch ⅛ inch from each corner of the bead dropout section CSa, one center stitch with a lock stitch placed in the center of the bead dropout section Ctr, one corner stitch with a lock stitch ⅛ inch from each corner of the bead dropout section CSb, one intermediate section stich ISb placed between the dropout sections.

Figure 15A:
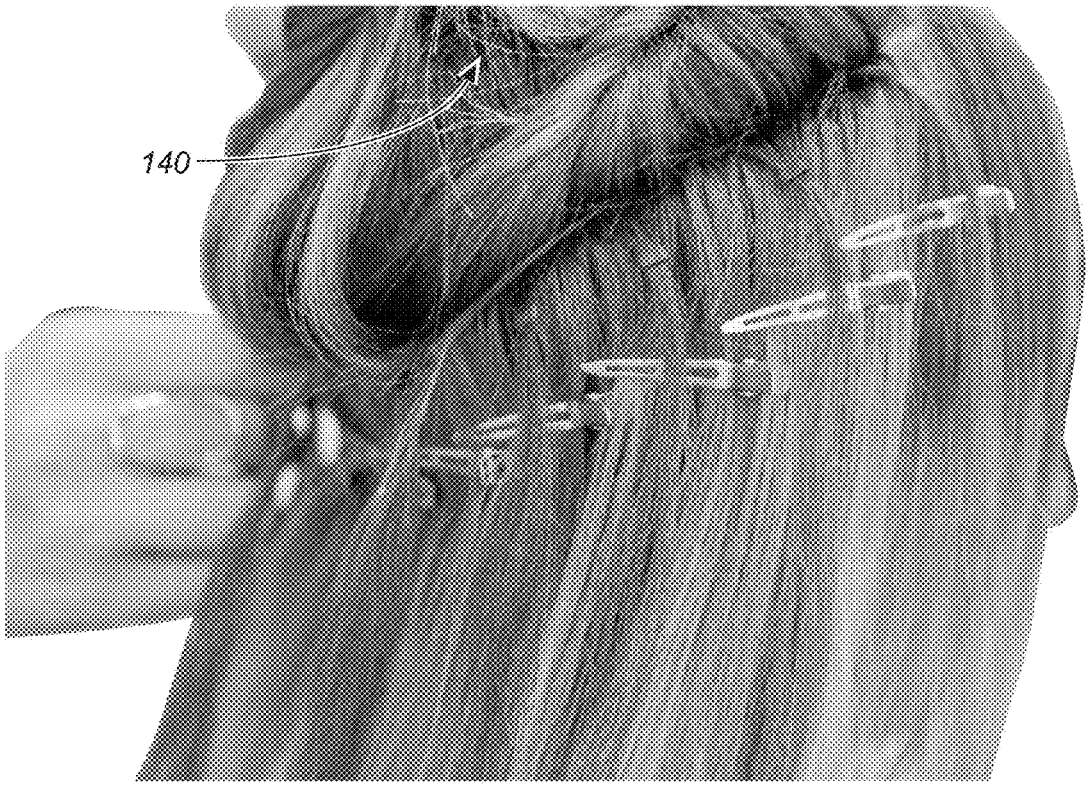
FIG. 15A is the first in a series of illustrations showing how beads are adjusted up to meet the weft line after stitching is completed.
Figure 15B:
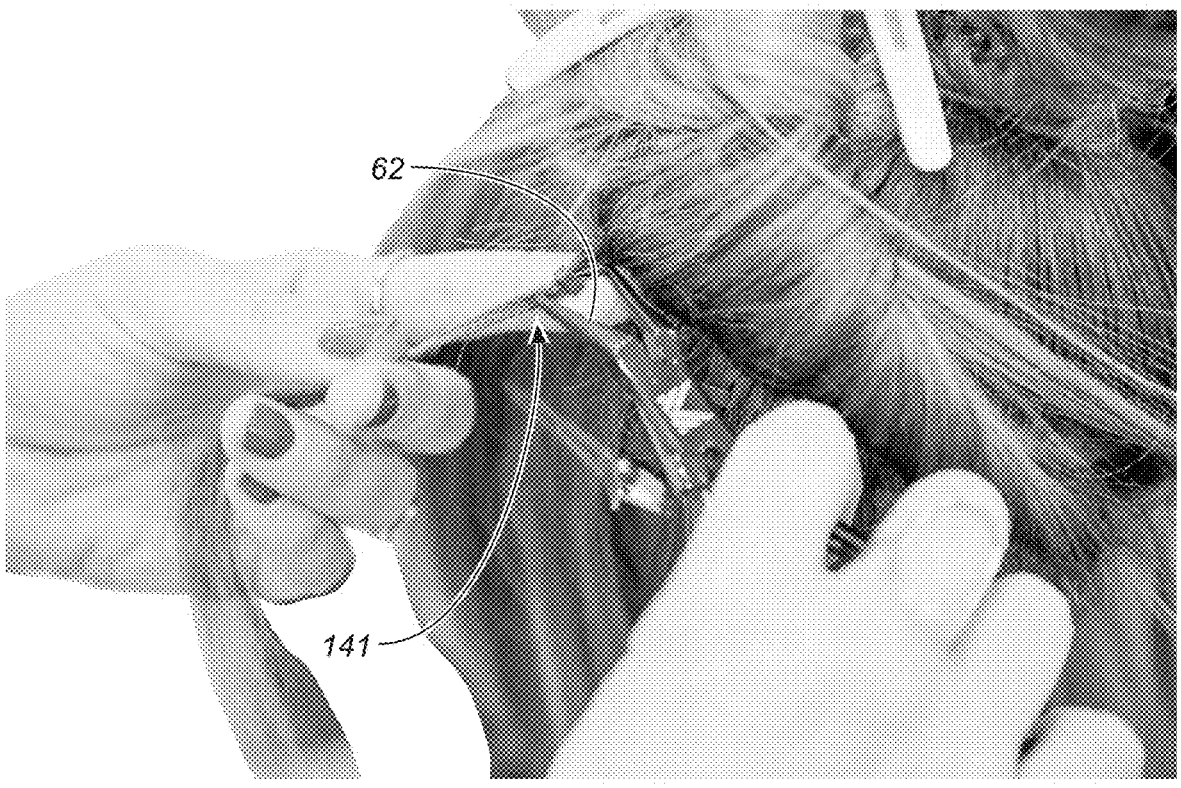
FIG. 15B is the second illustration thereof.
Figure 15C:
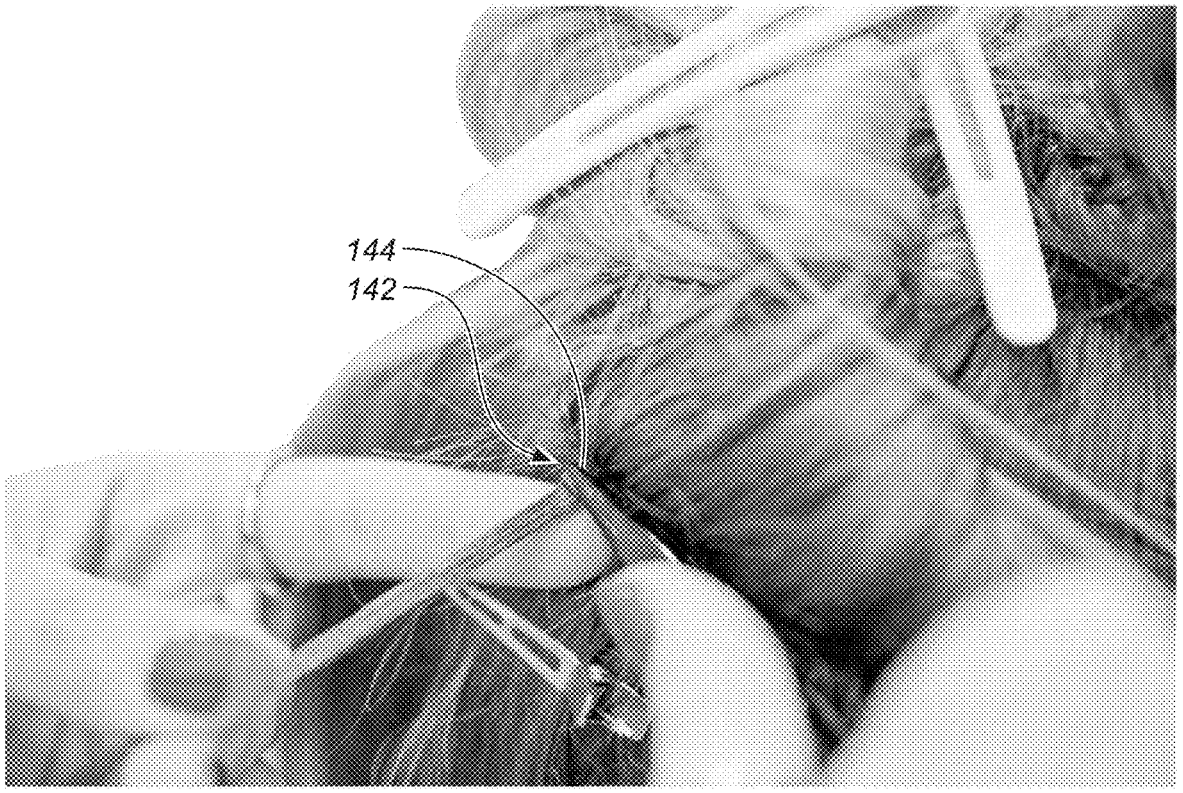
FIG. 15C is the third illustration thereof.
Figure 15D:
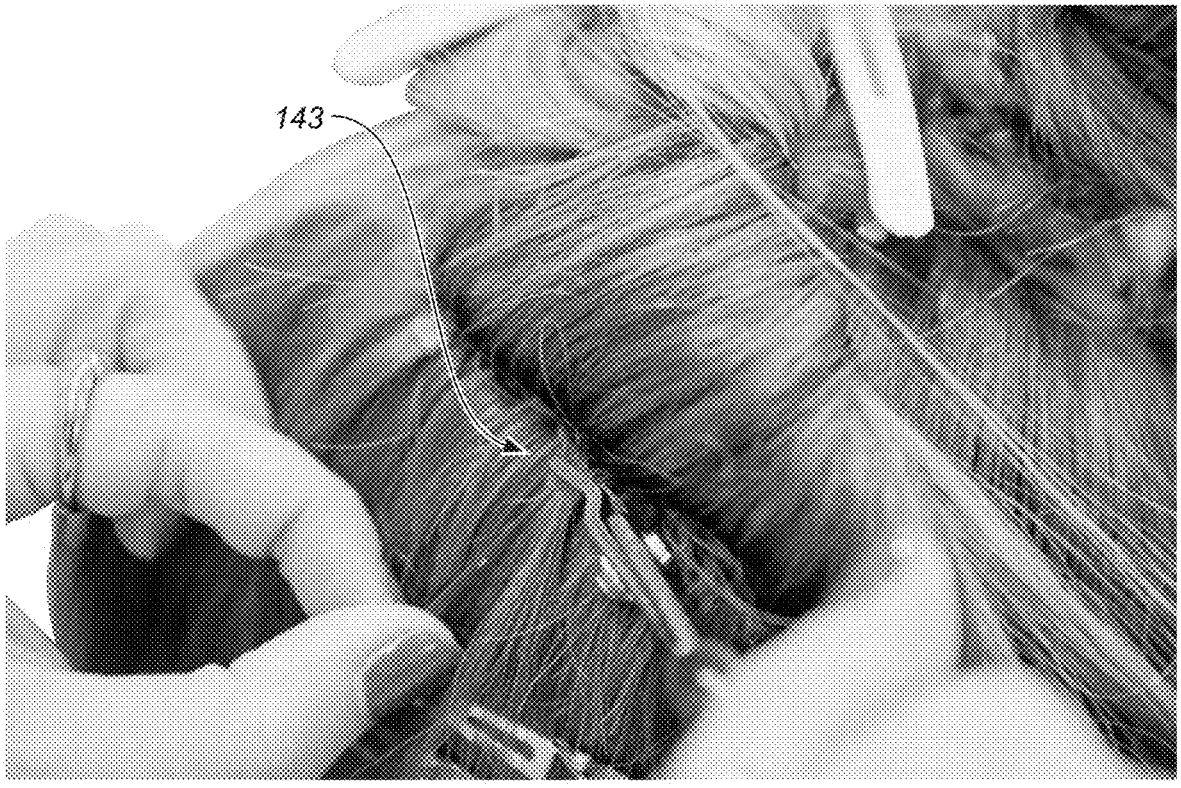
FIG. 15D is the fourth illustration thereof.
Figure 15E:
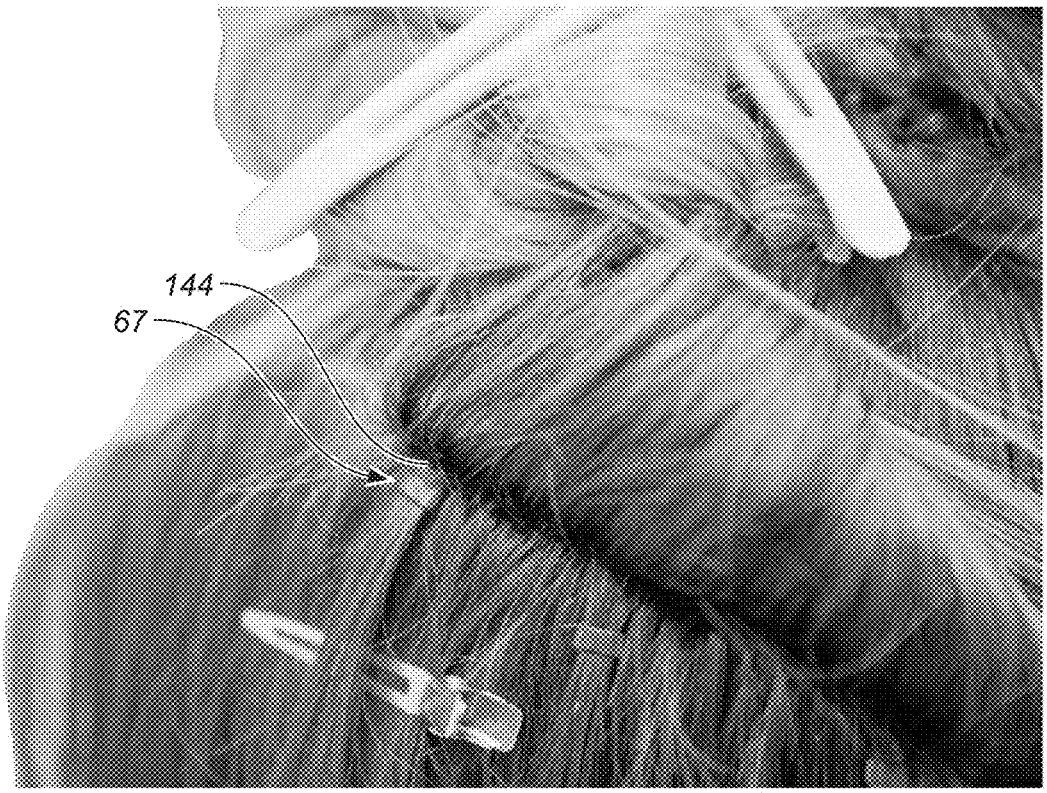
FIG. 15E shows a finished bead placement.

Once the stitching is completed, the beads are adjusted up as depicted in FIGS. 15A-15C to ensure the hair will not cinch tight, causing loss of blood flow to the scalp of follicle pulling. The stylist initially secures the hair above the weft clips [step 140, FIG. 15A]. Using the bead opener tool 62, all the beads around the row section are opened [step 141, FIG. 15B]. Once opened, the beads are slid up to the weft line 144, keeping ⅛ inch of space between the bead and the weft line [step 142, FIG. 15C]. The beads 67 are then re-positioned in the center of the bead dropout section by holding the section out at 90-degrees, letting go of the tension, turning the pliers to 45-degrees, and clamping the bead closed. After all the beads are re-positioned, they are secured with the bead crimper tool [step 143, FIG. 15D]. The stylist ensures the crimper tool is centered on the bead to crimp properly. The finished bead 67 will lay flat ⅛ inch below the weft line 144. This entire bead adjustment process, after stitching is completed, enables the stylist to remove tension on the user's scalp.

Figure 16A:
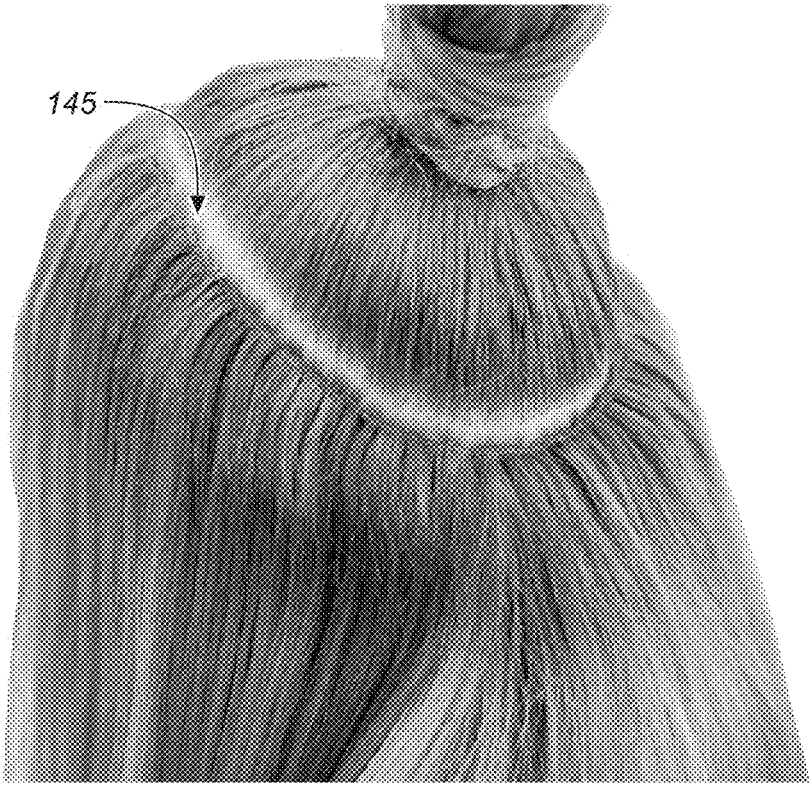
FIG. 16A is a first view illustrating proper placement of a completed row.
Figure 16B:
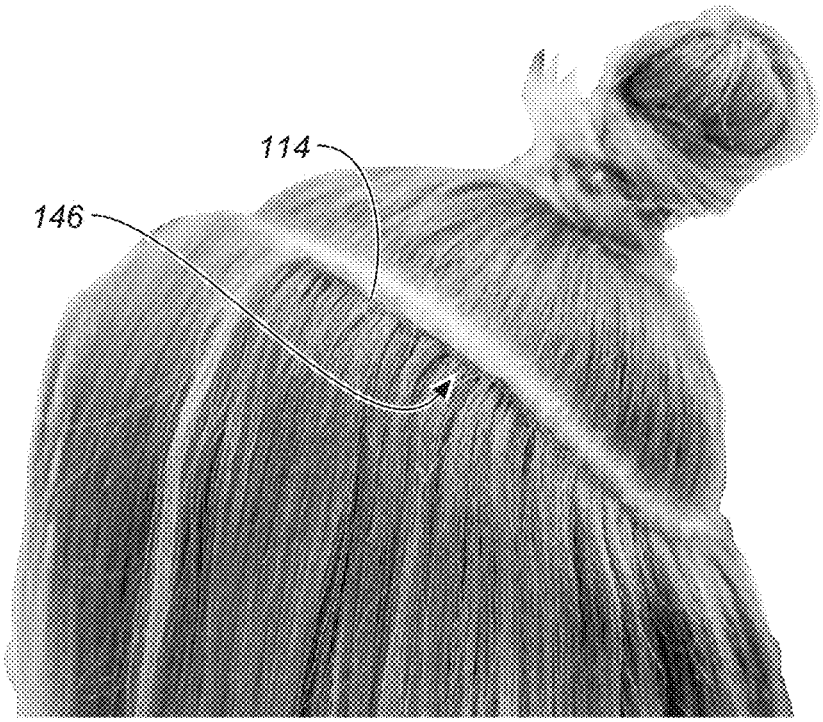
FIG. 16B is a second view providing detail thereof.
Figure 16C:
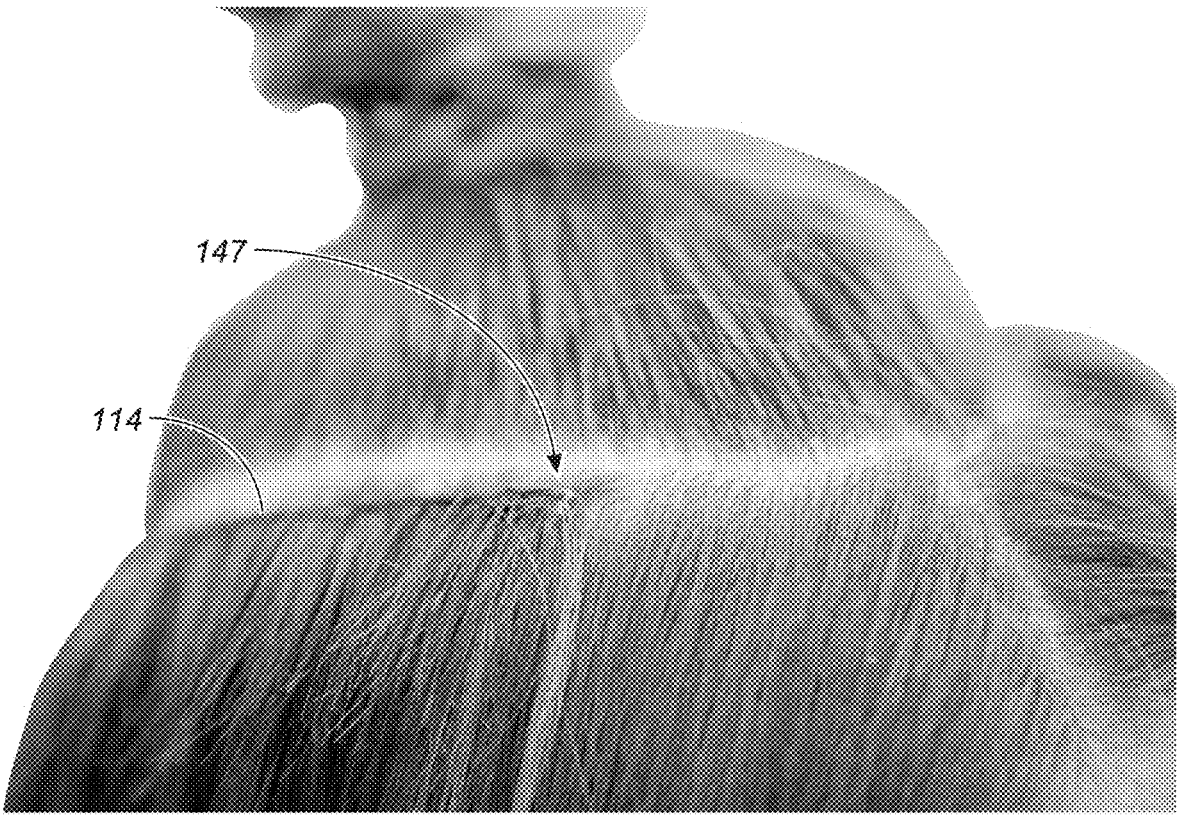
FIG. 16C is a third view providing further detail thereof.
Figure 17A:
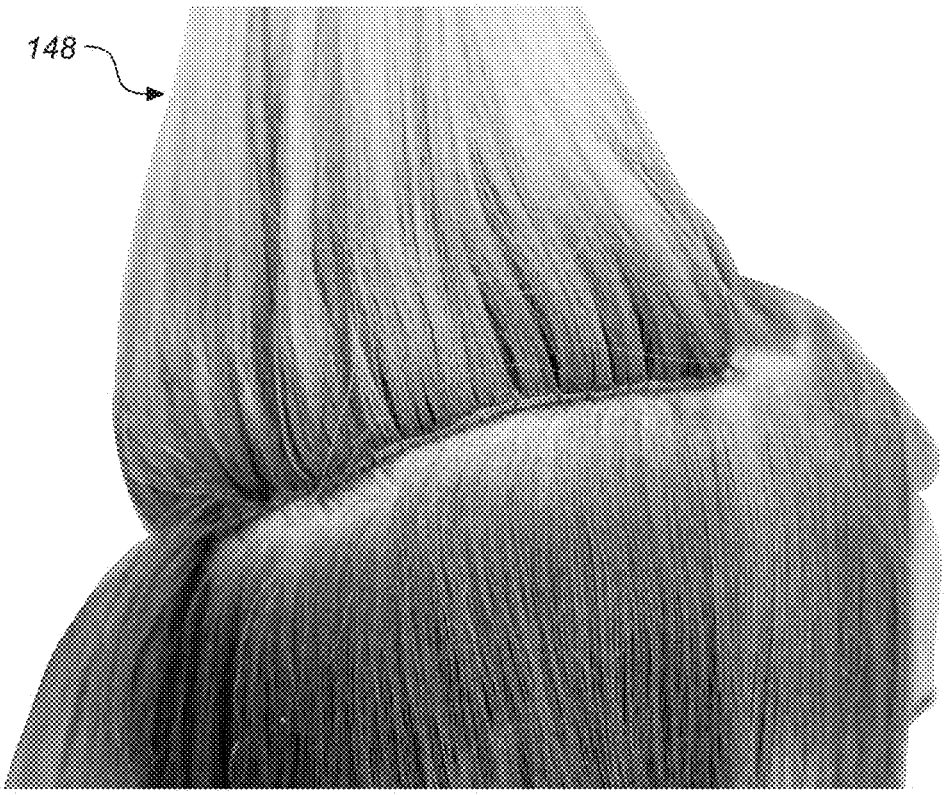
FIG. 17A is a first view illustrating how to clean up loose hair picked up during stitching.
Figure 17B:
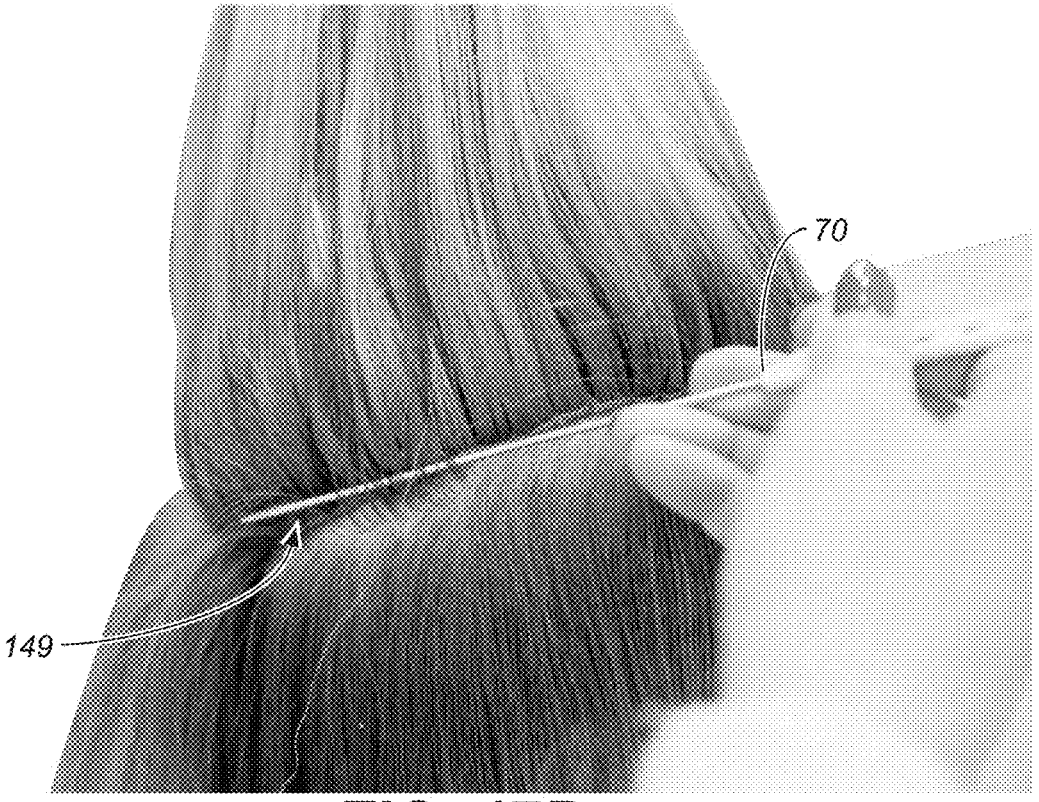
FIG. 17B is a second view thereof.
Figure 17C:
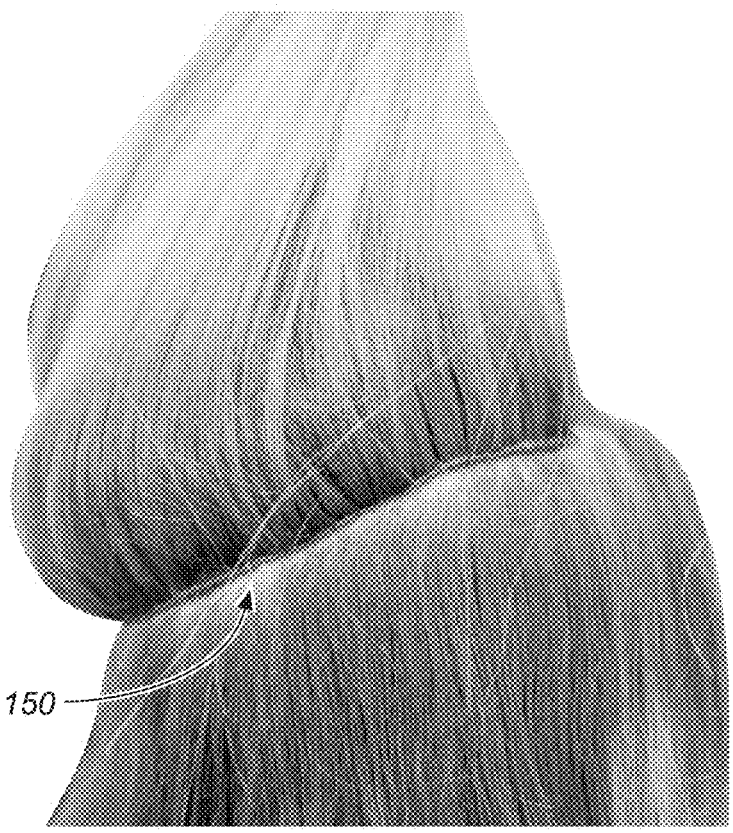
FIG. 17C shows the finished weft placement with no visible bead dropout section showing.

Proper placement of the completed row, as illustrated in FIGS. 16A-16C, will be ¼ inch from the top part line 145 and the wefts 114 will be oriented in a straight line 146. If the weft line waves, the beads may be adjusted to straighten the line. The wefts on each corner will be back ⅛ inch from the end of the section 147. To clean up any loose hair that was inadvertently picked up during stitching, the stylist will lift up the row section [step 148, FIG. 17A], and using a hair separator tool 70 will slide out any loose hair [step 149, FIG. 17B]. The resulting wefts will be in a seamless line with no visible bead dropout sections showing 150, shown in FIG. 17C.

The above disclosure is sufficient to enable one of ordinary skill in the art to practice the invention and also provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A method of installing hand-tied natural hair extensions to a wearer's natural hair, comprising the steps of:

a sectioning stage, including, determining an optimal location to begin sectioning in relation to a client's part line and hairline above the ear, and sectioning a top portion of the client's hair to create a top section and a bottom section separated by a section line;

a clearing stage for gathering the top section of the client's hair on top of a client's head to separate the top section of hair and create a clean section in which to work unimpeded by uncontrolled strands of hair;

a row formation stage to create one or more rows of hair below the section line;

a bead dropout section formation stage to form one or more rows of arched bead dropout sections starting at a first row closest to the client's face and working to a rear section of the client's head, including, dividing the one or more rows of hair below the section line into a plurality of approximately 1⅛ inch-wide rectangular hair sections;

threading a bead into each rectangular hair section at a distance of approximately 1 to 1⅛ inches from a client's scalp by twisting and bending each hair section into a loop and inserting said loop through a bead opening and pulling the hair section through the bead opening to form a soft, waterfall bend that creates flexibility in the bead dropout section removing initial tension on the scalp and hair follicle;

finishing the first row of bead dropout sections by connecting a plurality of beads in a back section at said rear section of the client's head; and lifting the row of bead dropout sections and securing the bead dropout sections to the top of the head with a clip;

a first, inner weft placement stage, including securing four to eight inner wefts below the row of bead dropout sections;

a second, outer weft placement stage, including securing four to eight outer wefts are secured above the row of bead dropout sections;

a stitching stage for stitching the inner and outer wefts together which includes, working in and about a single dropout section at a time, placing a first intermediate section stich between dropout sections, a corner stitch with a lock stitch ⅛ inch from each corner of a bead dropout section, one center stitch with a lock stitch placed in the center of the same bead dropout section, one corner stitch with a lock stitch ⅛ inch from each corner of the same bead dropout section, and a second intermediate section stich placed between the dropout sections on an opposing side of the first intermediate section stitch; and a bead adjustment stage after the stitching phase to open the bead and adjust the bead further from the client's scalp and eliminate tension and distortion on the client's scalp, including, opening the bead opening of each of the beads around the bead row section and sliding the beads up to a weft line to remove tension on the client's hair and to prevent the client's hair from cinching tight and to re-center each of the beads in each of the hair sections, keeping ⅛ inch of space between the bead and the weft line, re-positioning each bead in the center of its respective bead dropout section spaced from the client's scalp to prevent tension on the client's hair after the bead adjustment stage, and securing each bead with a bead crimper tool such that each finished bead lays flat approximately ⅛ inch below the weft line and such that each completed row of wefts is approximately ¼ inch from a client's top part line and the wefts are oriented in a straight line.

* * * * *